US009913512B2

(12) United States Patent
Bachmann

(10) Patent No.: US 9,913,512 B2
(45) Date of Patent: Mar. 13, 2018

(54) FOOTWEAR WITH RETRACTABLE SPIKES

(71) Applicant: KICK-SPIKE ENTERPRISES LTD., Penticton (CA)

(72) Inventor: Darrell Patrick Bachmann, Penticton (CA)

(73) Assignee: KICK-SPIKE ENTERPRISES LTD., Penticton (CA)

( * ) Notice: Subject to any disclaimer, the term of this patent is extended or adjusted under 35 U.S.C. 154(b) by 265 days.

(21) Appl. No.: 14/259,902

(22) Filed: Apr. 23, 2014

(65) Prior Publication Data

US 2015/0305445 A1 Oct. 29, 2015

Related U.S. Application Data

(63) Continuation-in-part of application No. 13/138,974, filed as application No. PCT/CA2010/000038 on Jan. 19, 2010, now abandoned.

(30) Foreign Application Priority Data

May 7, 2009 (CA) ..... PCT/CA2009/000602

(51) Int. Cl.
*A43B 5/00* (2006.01)
*A43C 15/14* (2006.01)

(52) U.S. Cl.
CPC ..... *A43C 15/14* (2013.01); *A43B 5/001* (2013.01)

(58) Field of Classification Search
CPC ..... A43C 15/14
USPC ..... 36/134, 135, 67 R, 67 A, 67 B, 67 C, 36/67 D, 127, 61
See application file for complete search history.

(56) References Cited

U.S. PATENT DOCUMENTS 1,487,976 A * 3/1924 Rossi ..... A43C 15/14 36/61
2,920,404 A * 1/1960 Ross ..... A43C 15/14 36/61
3,793,751 A * 2/1974 Gordos ..... A43C 15/14 36/127
4,821,434 A * 4/1989 Chein ..... A43C 15/14 36/134

(Continued)

FOREIGN PATENT DOCUMENTS

WO WO 2005041707 A1 * 5/2005 ..... A43C 15/14

*Primary Examiner* — Khoa Huynh
*Assistant Examiner* — Katharine Gracz
(74) *Attorney, Agent, or Firm* — Antony C. Edwards

(57) ABSTRACT

An apparatus for selectively extending and retracting spikes includes spike actuating assemblies mounted to, and cooperating between, a first plate and a first slider frame, and a second plate and a second slider frame, pivotally mounted to the first plate and first slider frame respectively. Each spike actuating assembly contains a spike. The first slider frame is translatable to actuate the spike actuating assemblies to thereby extend and retract the spikes from the spike actuating assemblies. A cyclically alternating positioner is mounted on the first plate for moving the first and second slider frames relative to the first and second plates. The positioner has only a single actuating button adjacent the heel. Depressing the actuating button a first time causes the positioner to move the slider frames to extend the spikes. Depressing the actuating button a second time causes the positioner to move the slider frames to retract the spikes.

17 Claims, 43 Drawing Sheets

(56) References Cited

U.S. PATENT DOCUMENTS

| | | | | | |
|---|---|---|---|---|---|
| 5,269,080 | A * | 12/1993 | Davis | A43C 15/14 | 36/114 |
| 5,337,494 | A * | 8/1994 | Ricker | A43C 15/14 | 36/134 |
| 5,497,565 | A * | 3/1996 | Balgin | A43C 15/14 | 36/134 |
| 5,557,865 | A * | 9/1996 | Sjosvard | A43C 15/14 | 36/134 |
| 5,737,855 | A * | 4/1998 | Jordan | A43C 15/14 | 36/134 |
| 5,946,828 | A * | 9/1999 | Jordan | A43B 5/001 | 36/134 |
| 5,956,870 | A * | 9/1999 | Grossman | A43B 5/001 | 36/127 |
| 6,125,556 | A * | 10/2000 | Peckler | A43C 15/14 | 36/127 |
| 6,256,907 | B1 * | 7/2001 | Jordan | A43C 15/14 | 36/134 |
| 6,389,714 | B1 * | 5/2002 | Mack | A43C 15/14 | 36/100 |
| 7,152,344 | B2 * | 12/2006 | Yoo | A43C 15/063 | 36/59 R |
| 8,122,617 | B1 * | 2/2012 | Dixon | A43C 15/14 | 36/61 |
| 8,510,973 | B2 * | 8/2013 | Bachmann | A43B 13/26 | 36/127 |
| 8,578,631 | B2 * | 11/2013 | Francello | A43B 13/203 | 36/127 |
| 2005/0229434 | A1 * | 10/2005 | Yoo | A43C 15/063 | 36/59 R |
| 2010/0229428 | A1 * | 9/2010 | Bachmann | A43C 15/14 | 36/134 |
| 2011/0047830 | A1 * | 3/2011 | Francello | A43B 13/203 | 36/134 |

* cited by examiner

FOOTWEAR WITH RETRACTABLE SPIKES

CROSS REFERENCE TO RELATED APPLICATIONS

This application is a continuation-in-part of U.S. application Ser. No. 13/138,974 filed Nov. 7, 2011, which is a national phase entry from PCT application number PCT/CA2010/00038 filed Jan. 19, 2010, which claims priority from PCT application number PCT/CA2009/000602 filed May 7, 2009.

FIELD OF THE INVENTION

The present invention relates to footwear in general and to a method and apparatus for providing footwear with selectively extendable spikes in particular.

BACKGROUND OF THE INVENTION

Traction is necessary for proper performance in many endeavors including those involving sports and recreation, professions and trades including fire fighting and policing, in the military and in particular infantry, to name just a few. For example, in the sport of golf, proper traction is required during full swing shots such as the tee shot and many fairway shots. Due to the grass covered surfaces on which golf is played, however, proper traction may be difficult. It is well known that the addition of spikes to the bottom of footwear for golf shoes helps to provide the necessary traction on such a surface. Such spikes were traditionally made of sharpened elongate metal projections.

Traditional metal spikes, however, suffered from the disadvantage of being damaging to some surfaces. In particular, the putting greens surfaces which have a significantly shorter grass length have been found to be damaged by metal spikes. Such metal spikes have been known to cause significant damage to putting greens by leaving holes and ridges in the ground as well as damaging the more delicate putting green grasses.

One solution to the above disadvantages of metal spikes has been to replace the traditional metal spikes with a spike insert comprising a plurality of plastic or rubber protrusions which are also known as the "soft spike". Soft spikes have resulted in less damage to the putting greens surfaces. Accordingly, many golf courses have enacted rules prohibiting traditional metal spikes in favor of soft spikes. However, soft spikes have also reduced the fraction provided to the golfer during full swing shots such as the tee shot. Therefore, while most recreational golfers now use soft spikes, many professional players continue to use metal spikes. The use of metal spikes for professional golf tournaments results in a significant amount of damage to the putting greens which is both costly to repair as well as obstructive to the play of later players.

Soft spikes have also not completely eliminated the damage occurring to golf course greens. As developers of soft spikes have attempted to increase the traction provided by soft spikes, the amount of damage these spikes inflict on putting greens increases. In particular, it is known that metal spikes and newer designs of soft spikes results in damage to the structure of the grass making these grasses more susceptible to disease and other difficulties. Putting greens therefore require more fungicides, pesticides and water to ameliorate the damage caused to the grass from metal and soft spikes.

In these and other uses such as in the military, for use outdoors, or in sports other than golfing, or for other recreational or trades or professional uses where selectively actuable traction offered by selectively extendible and retractable spikes is advantageous, it is also advantageous and an object of the present invention to provide a structure substantially or more advantageously even entirely enclosed from the outside elements in a sole which is rugged and yet flexes with at least the toe portion of the foot of the wearer.

In the prior art attempts have been made to provide shoes with selectively extendable and retractable spikes. Examples of such shoes may be found in U.S. Pat. No. 4,821,434 to Chein, U.S. Pat. No. 6,058,627 to Violette et al., U.S. Pat. No. 5,299,369 to Goldman, U.S. Pat. No. 6,256,907 to Jordan et al., and U.S. Pat. No. 4,375,729 to Buchanen, III, and in Canadian patent application no. 2,510,291 filed May 27, 2005 by Jones. However, such devices have not been suitable as for example in some there are separated controls to extend or retract the spikes. Several of these controls are located in the toe of the sole where they may cause tripping while climbing or in inclined terrain or be prone to actuation for example during the follow-through of a golf swing, etcetera. Other designs in the prior art are inferior in that relatively large pieces of actuating structure are exposed outwardly of the sole making damage to the structure or the intrusion of water, dirt, snow, etcetera more likely.

Other attempts have required the user to activate the extension or retraction of the spikes from the sole of the shoe by manipulating a tab lever, screw or other device on the sole of the shoe itself. Examples of such devices may be found at U.S. Pat. No. 5,836,092 to Yarnell, U.S. Pat. No. 5,497,565 to Balgin, U.S. Pat. No. 6,389,714 to Mack, U.S. Pat. No. 5,956,870 to Grossman et al., U.S. Pat. No. 6,256,907 to Jordan et al., U.S. Pat. No. 5,732,482 to Remington et al., U.S. Pat. No. 5,870,838 to Khayat and U.S. Pat. No. 5,269,080 to Davis. Such devices have not been acceptable due to the need to bend down to extend or retract the spikes which may be difficult for some users and time consuming.

SUMMARY OF THE INVENTION

The present invention is an apparatus for selectively extending and retracting spikes from the sole of a footwear article, where the sole has a heel section, a center under-the-arch of the foot section (herein a "center" section), a ball-of-the-foot section (herein a "ball" section), and toe section extending consecutively in a longitudinal direction along the sole. A plurality of spike apertures are formed through the heel, ball and toe sections. The apparatus includes spike actuating assemblies mounted to, and cooperating between a first plate and a first slider frame, and a second plate and a second slider frame. Each spike actuating assembly contains a spike which is locatable within a corresponding one of the spike apertures in the sole.

The first plate has heel, center and ball portions sized to extend over so as to cover respectively the heel, center and ball sections of the sole when the first plate is mounted on the sole. The first slider frame is elongate and longitudinally translatable mounted flush on the first plate. The first slider frame has heel, center and ball sub-frames covering respectively the heel, center and ball portions of the first plate. The first slider frame is translatable between first and second positions. The first slider frame is operable to actuate the spike actuating assemblies to thereby extend the spikes from the spike actuating assemblies at the first position and to retract the spikes at the second position.

A cyclically alternating positioner is mounted on the first plate for moving the first slider frame between the first and second positions. The positioner has only a single actuating button adjacent the heel portion. Depressing the actuating button a first time causes the positioner to move the first slider frame to the first position. Depressing the actuating button a second time causes the positioner to move the first slider frame to the second position.

The second plate is adjacent a front end of the ball portion of the first plate so as to cover the toe section of the sole when the first and second plates are mounted on the sole. The second slider frame is slidably mounted flush on the second plate. The second slider frame pivotally is mounted to a front end of the ball sub-frame of the first slider frame. At least one spike actuating assembly is mounted on the second plate. When the first slider frame is moved between the first and second positions, the second slider frame is correspondingly simultaneously moved relative to the second plate and correspondingly actuates the spike actuating assembly on the second plate to simultaneously extend and retract a corresponding the spike therefrom.

Each spike actuating assembly further comprises a rigid housing mounted to the first plate and slidably encases a corresponding spike. In one preferred embodiment a knee-lever linkage is pivotally mounted at a first end thereof to the rigid housing and at an opposite second end to the first slider frame. The knee-lever linkage includes at least an upper link and a lower link pivotally mounted to one another at a mid-pivot between the first and second ends of the knee-lever linkage. The mid-pivot is connected to the corresponding spike. When the first slider frame is in the first position so as to extend the corresponding spike the upper and lower links are substantially linearly aligned and collectively upwardly inclined so as to transfer a substantial vector component of an upward force acting on the corresponding spike to the rigid housing via the mid-pivot and the linearity of the substantially linearly aligned upper and lower links.

In one preferred embodiment the center portion of the first plate is waisted when viewed in planform relative to a width of the heel and ball portions. The center sub-frame of the first slider frame is correspondingly waisted so as to substantially conform in width when overlaid onto the center portion.

The positioner may in one embodiment include a cyclical actuator mounted both on the center portion of the first plate and the center sub-frame of the first slider frame so as to cooperate therebetween to drive the first slider frame between the first and second positions relative to the first plate. In this embodiment a drive member extends between the button and the cyclical actuator.

Advantageously the spike actuating assemblies are mounted on the first plate in spaced apart array so as to provide a longitudinally extending unobstructed center corridor along the first plate extending substantially the entire length of the first plate. The array is also longitudinally spaced to provide longitudinal spacing between the plurality of spike actuating assemblies. The first slider frame includes a center back-bone frame extending substantially completely along the heel, center and ball sub-frames. The back-bone frame freely slides along the center corridor of the first plate. The first slider frame includes laterally extending arms from the center back-bone frame cooperating with the of spike actuating assemblies so as to actuate the spikes.

The laterally extending arms may advantageously further include longitudinally extending arms at the distal ends of the laterally extending arms in a T-shape for example, so as to define substantially U-shaped brackets around each spike actuating assembly. The U-shaped brackets drive each spike actuating assembly simultaneously from opposite sides thereof.

The first plate may further include guide members cooperating with the first slider frame to constrain sliding translation of the first slider frame between the first and second positions, and to constrain the translation to be flush translation substantially flush along the first plate. In one embodiment the flush translation is without any vertical translation of the first slider frame relative to the first plate.

The actuating button may comprise a plunger button acting against a return biasing spring. The plunger button may be cantilevered from a heel portion of the sole in a substantially horizontal plane. A portion of the sole covers the actuating button, or the actuating button may be contained within the sole. The positioner is cyclically actuated by single consecutive pushes of the button applied to rear of the sole against a return biasing force of a single resilient biasing spring. The spring may act against and between the first plate and the button. The spring may be a helically coiled spring. A rod may extend from the button along the heel portion to the center portion of the first plate. The rod may be journalled through the helically coiled spring, and may be substantially parallel to the first plate and substantially longitudinally aligned.

In a preferred embodiment a third link in the knee-lever linkage is pivotally connected between the mid-pivot and an upper end of the corresponding spike. Advantageously, the upper link is mounted to the housing at an upper end of the housing, and the lower link is mounted to the first slider frame. In one embodiment the housing is a spike guide which defines a substantially vertical silo for a spike to slide vertically therein as the mid-pivot is lowered or elevated upon translation of the first slider frame between the first and second positions respectively.

In a further embodiment of an apparatus for selectively extending spikes from the bottom of a footwear article, where the footwear article has a sole having a longitudinal direction and a plurality of spike apertures, the apparatus includes spike assemblies, an elongated slider member on at least one plate, and a cyclically alternating positioner. The spike assemblies each have a spike guide and a selectively translatable spike slidably supported in the guide. Each spike has a cam follower coupled thereto and extending from said spike for translation with said spike. Each spike is locatable within one of the spike apertures in the bottom of the footwear article.

The elongate slider member is mountable into the footwear article so as to be translatable substantially parallel to the longitudinal direction of the footwear article. The elongate member cooperates with the plurality of spike assemblies, and is moveable between first and second positions relative thereto, so as to extend the spikes from the plurality of spike assemblies when in the first position and to retract the spikes within the plurality of spike assemblies when in the second position. The cyclically alternating positioner is for moving the elongate member between the first and second positions. The positioner has an actuating push button. Depressing the actuating button a first time causes the positioner to move the elongate member to the first position. Depressing the actuating button a second time causes the positioner to move the elongate member to the second position.

For each spike assembly, a carriage is coupled to said elongate member for translation with the elongate member between the first and second positions for transmitting the translation of the elongate member to the spike assemblies. Each carriage has an inclined cam slot in the carriage. The cam slots have opposite upper and lower ends.

The cam followers are mounted in sliding registry within their corresponding inclined cam slots in their corresponding carriages. The cam follower is in the lower end of the cam slot when the elongate member is in the first position. The cam follower is in the upper end of the cam slot when the elongate member is in the second position.

Each cam slot may lie in a substantially vertical plane. Each carriage may include at least one wall having a cam slot formed therein. Each carriage may be coupled to the elongate member by a corresponding arm extending between the carriage and the elongate member.

In one embodiment each carriage has two walls so as to extend the walls on opposite sides of its corresponding spike assembly. That is, one wall is positioned on each side of the spike assembly. One cam slot may be formed in each wall, in which case the cam follower includes a pair of cam followers extending from opposite sides of each spike into corresponding cam slots so as to support each spike from both sides of the spike. Advantegeously each arm extending from the elongate member extends to both of the two walls of the carriage to assist in smooth sliding of the carriage on the plate without misalignment of the carriage or binding of the carriage.

In one embodiment the elongate member is sandwiched between a pair of plates for sliding translation between the pair of plates. The spike guides maybe, or form, hollow sleeves or blocks, wherein each hollow sleeve or hollow block is mounted so as to extend from at least one plate of the pair of plates to support a corresponding spike, and to help resist a bending moment applied to the spike when extended.

Each carriage may be shaped as an inverted channel, wherein each channel has a floor and a pair of sidewalls extending from the floor. The pair of sidewalls may form the aforesaid of two walls of the carriage. The floor may have a cut-out for movement of a corresponding spike therethrough.

In one embodiment each cam slot has an inclined portion and a horizontal portion, wherein the horizontal portion is at the lower end of the cam slot. A cam follower is positioned in the horizontal portion of the cam slot when the elongate member is the first position, that is, with the spikes extended, whereby vertical loading on the spike is transmitted directly to the carriage, and thence to the plate against which the carriage bears. The elongate member and the carriage slide over that plate.

When the carriage bears against the plate so as to evenly distribute the vertical loading to the plate, sliding friction between the carriage and the plate may be reduced, and pressure due to the loading from the carriage against the plate is distributed to the plate to reduce or minimize interference with the sliding of the carriage on the plate. In one embodiment, the plate may be an upper plate, and the carriages and the elongate member are slidably mounted underneath the upper plate. A lower plate may be provided so that the elongate member is sandwiched, for sliding translation, between the upper and lower plates.

BRIEF DESCRIPTION OF THE DRAWINGS

In drawings which illustrate embodiments of the invention wherein similar characters of reference denote corresponding parts in each view.

DETAILED DESCRIPTION OF EMBODIMENTS OF THE INVENTION

Figure 1:
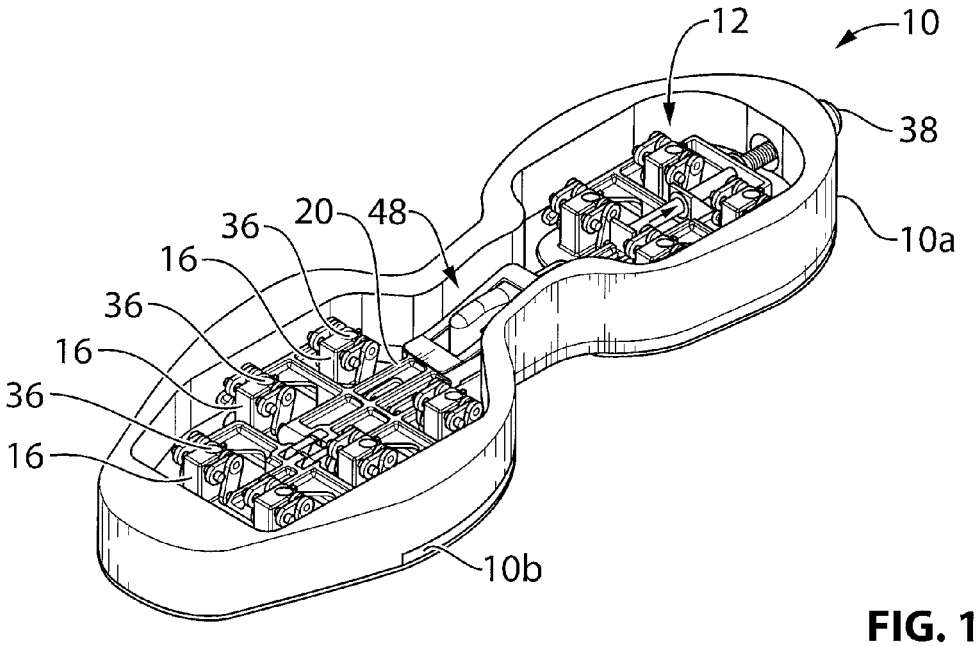
FIG. 1 is in front perspective view, a sole containing the spike actuating mechanism according to the present invention.

Sole 10 provides a resilient housing for example standing approximately between one half and three quarters of an inch high to define by a perimeter wall 10*a* and enclosed internal cavity 12 in which is mounted the spike actuation assembly according to the present invention.

The spike actuation assembly includes a mounting plate 14 on which are formed or mounted substantially vertically up-standing spike guides 16. In the illustrated embodiment which is not intended to be limiting, four spike guides 16 are provided on the heel portion 14*a*, four spike guides 16 on ball portion 14*b*, and two spike guides 16 on separate toe mounting plate 18. A shifter frame 20 is mounted overlaid onto mounting plate 14 so as to overlay sub frame 20*a* onto heel portion 14*a* and sub frame 20*b* onto ball portion 14*b*. Sub-frames 20*a* and 20*b* are interconnected by a relatively narrower or waisted center sub-frame 20*c* which overlays onto a corresponding waisted portion 14*c* of mounting plate 14.

Sub-frames 20*a* and 20*b* each include oppositely disposed t-frames 22 extended cantilevered on members 22*a* from center sub-frame extensions 20*d* and 20*e* extending into sub-frames 20*a* and 20*b* respectively from the corresponding ends of center sub-frame 20*c*. Gussets 22*b* lend rigidity to members 22*a* at the intersections of members 22*a* with sub-frames 20*e* and 20*d*, and also lend rigidity to t-frames 22.

Pins 22*c* are mounted onto the opposite ends of the cross bars oft-frames 22 and are laterally aligned, inwardly disposed in opposed facing relation to the pins 22*c* mounted on the opposite t-frame 22. In total four t-frames 22 are mounted to the center section of shifter frame 20, disposed so as to define a generally rectangular frame having a narrow waisted section in the middle. The t-frames 22 in conjunction with the sub-frames 20*d* and 20*e* form generally U-shaped structures which support pins 22*c* on a first side of the U-shape and pins 24 on the opposite side of the U-shape, mounted so as to extend laterally of sub-frames 20*d* and 20*e*. Pins 24 align in opposed facing relation with the corresponding pins 22*c* on the corresponding t-frame 22.

Pins 22*c* are mounted to one end of exterior knee-links 26. The opposite ends of exterior knee-links 26 are pinned by means of pins 28*a* to the common ends of knee-links 28 and knee-links 30.

The pins 24 and the opposite ends of shaft 32 are pivotally mounted to one end of interior knee-links 34. Interior knee-links 34 are pinned by pins 28*b* to the common ends of knee-links 28 and knee-links 30. The opposite ends of knee-links 28, opposite from pins 28*b* are pivotally mounted to pins 28*a* rigidly mounted to and extending laterally from spike guides 16. The opposite ends of knee-links 30, opposite from pins 28*b* are pivotally mounted to the upper ends of spikes 36 by pins 30*a*.

Spikes 36 are slideably mounted within vertically elongate generally cylindrical hollow bores 16*b* formed in spike guides 16. Oppositely laterally disposed vertical slots 16*c* are formed in the side-walls of cylindrical bores 16*b*. The ends of knee-links 30 opposite pins 28*b* are pivotally mounted to spikes 36 by pins 30*a* extending from knee-links 30 through slots 16*c*.

Longitudinal translation of shifter frame 20 in direction A pulls exterior knee-links 26 and interior knee-links 34 simultaneously in direction B thereby driving knee-links 30 in direction C as constrained by slots 16*b*. This drives spikes 36 downwardly in direction D into their fully extended position. Once in their fully extended position, spikes 36 are held in place by the tension provided by shift frame 20 on knee-links 26 and 34, transmitted to knee-links 30 by pins 28*b*, and transmitted to spikes 36 by pins 30*a*. It is important to note that most of the reactive force resisting the refraction of spikes 36 in direction D' comes not from an upward pressure applied to shifter frame 20 via the pins and links but rather as a result of an upward force acting on spike guides 16 by the transfer of a reactive force along substantially that of force vector line E shown in dotted line. As indicated by force vector line E, links 28 and 30 are substantially co-linear when the spikes are fully extended. Thus most of the reactive force resisting the pushing of spikes 36 back up bores 16*b* when a user wearing footwear containing soles 10 according to the present invention steps down onto firm or solid ground, is transferred between spikes 36 and spike guides 16 by pins 30*a*, substantially along the longitudinal axis of knee-links 30, and via pins 28*b* to be transferred substantially along the longitudinal axis of knee-links 28, and then via pins 28*a* to spike guides 16. Thus, rather than bearing the brunt of the reactive force, shifter frame 20 primarily maintains tension on knee-links 26 and 34 in direction A and thereby tension on the junction between links 28 and 30.

When it is desired to retract spikes 36 upwardly so as to occupy bores 16*b*, the push button release mechanism 48 as better described below is actuated by pressing button 38 in direction F and then releasing button 38. This releases rod 40 so that rod 40 may translate in direction G urged by the resilient expansion of helical coil spring 42 mounted between button 38 and end plate 44. End plate 44 is rigidly mounted to so as to vertically extend from the end of heel portion 14*a* of mounting plate 14. Button 38 is rigidly mounted on the rear most end of rod 40. Rod 40 extends longitudinally along and over heel portion 14*a* and is rigidly mounted to shifter frame 20 at its end opposite to button 38, and in particular to sub-frame 20*d* by means of a pair of brackets 46.

Translation of rod 40 in direction G by the action of spring 42 urging button 38 in a direction opposite to direction F, translates shifter frame 20 in direction A', that is, opposite to direction A. As shifter frame 20 translates in direction A', t-frames 22 and in particular pins 22*c* drive knee-links 26 and 34 upwardly in a direction opposite to direction B thereby drawing knee-links 30 upwardly in a direction opposite to direction C guided upwardly along slots 16*b*, to thereby retract spikes 36 upwardly in direction D', that is, opposite to direction D. Shifter frame 20 and therefore spikes 36 are held in that position by the resilient biasing of spring 42 acting on rod 40.

When it is desired to extend spikes 36 from their retracted position, button 38 is again pushed in direction F and released. Pushing button 38 collapses spring 42, driving rod 40 in a direction opposite to direction G, and thereby driving shifter frame 20 in direction A so as to operate the knee-links in the manner described above. In a preferred embodiment it is understood that the distal end of button 38 would only protrude from the heel end of sole wall 10*a* sufficiently to be operable by a rearward kicking action of sole 10, the translation distance of rod 40 being kept to the minimum necessary to actuate the push button controller 48 as better described below. In one preferred embodiment, a resilient skin or cover or extension or compartment of sole wall 10*a* extends around so as to completely cover button 38 to thereby minimize the likelihood of intrusion of water, dirt or other material into the cavity 12 within sole 10. It is understood that, although not shown, seals (not shown) such as known in the art would be employed around button 38 where the button extends from the sole (if not fully contained within the sole) and around spikes 36 where they extend through rigid spike gaskets 50. Spike gaskets 50 are rigidly mounted into the underside of under-soles 10*b*. In one embodiment, a flexible fore-sole 10*c* is a affixed to the front edge of under sole 10*b* to allow for the upward flexing of the toe-end of sole 10 as toe mounting plate 18 pivots upwardly during use as better described below.

Translation of shifter frame 20 in direction A also shifts toe shifter frame 52 forwardly in a longitudinal direction forward of ball portion 14*b* of mounting plate 14 via shaft 32 and toe shifter links 54. Toe shifter links 54 are pivotally mounted at one end to shaft 32 and pivotally mounted at their opposite ends to toe shifter frame 52 so as to directly transmit longitudinal translation of shifter frame 20 to toe shifter frame 52 while allowing rotation of toe shifter frame 22 and toe mounting plate 18 in direction H out of a plane parallel to that of mounting plate 14. Rotation of toe shifter frame 52 and toe mounting plate 18 in direction H about both axis of rotation I and shaft 32 provides for flexing of the toe portion of sole 10 for example while a user is walking while wearing footwear containing soles 10, without interfering with the actuation of a pair of spikes 36 mounted in a corresponding pair of spike guides 16 on toe mounting plate 18.

The operation of the spike actuators cooperating on toe mounting plate 18 with toe shifter frame 52 are as described above with respect to the spike actuators on mounting plate 14. Thus toe shifter frame 52 is W-shaped so as to define a pair side by side U-shaped collars and corresponding corner reinforcing gussets. In particular, the arms 52*a* and base legs 52*b* of toe shifter frame 52 are reinforced corner gussets 52*c* and rigidly support at the distal ends of arms 52*a* pins 22*c*. As before, pins 22*c* are pivotally mounted to exterior knee-links 26 and interior knee-links 34, themselves pivotally mounted to knee-links 28 and 30 resulting in vertical actuation of spikes 36 upon horizontal translation of shifter frame 20 as transmitted to toe-shifter frame 52, where sub frame 20*e* is pivotally mounted onto shaft 32 by hooked tangs 20*f* interleaved between and one either side of toe shifter links 54.

In a preferred embodiment, toe shifter frame 52 and corresponding toe mounting plate 18 are laterally offset relative to shifter frame 20 and corresponding mounting plate 14 so as to fit within the asymmetric plan form of a conventional shoe sole, that is, so as to fit within the available area in a toe cap section of the sole forward of the ball portion corresponding to the ball of the foot of the user. In one preferred embodiment which is not intended to be limiting, this arrangement allows for the mounting of two laterally adjacent spike actuating mechanisms on toe mounting plate 18, for substantially equally spaced apart spike actuating mechanisms on ball portion 14*b*, and for substantially equally spaced apart spike actuating mechanisms on heel portion 14*a*. The spacing apart of the spike actuating mechanisms on the heel and ball portions 14*a* and 14*b* of mounting plate 14 provide a substantially centrally aligned longitudinally extending corridor between the left and right spike actuating mechanisms on the heel and ball portions of the mounting plate thereby providing room for the shifter frame guides 56 and the push button actuator 48. Shifter guides 56 may include bolts or screws having heads 56*a* which overlap on to lands 20*g* so as to hold the shifter frame 20 vertically downwards onto mounting plate 14, lands 20*g* defining slots 20*h* along which the bolts or screws and corresponding heads 56*a* slide. The ends of slots 20*h* provide stops governing the extent of the longitudinal translation of shifter frame 20 relative to mounting plate 14. The bolts or screws threadably mount down into correspondingly threaded nuts 58 or the like mounted on mounting plate 14 beneath slots 20*h*.

Push button actuating device 48 is modeled in its function on that of a push button switch sold by C & K Components under model number PN42LENA02QE and distributed by NEP Electronics Inc. of Wooddale, Ill., USA. Other push-button cyclically actuating positions would work as would be known to one skilled in the art. Push button actuating device 48 includes a leaf spring 60, mounted by a fastener 60*a* to the top side of shifter frame 20. Leaf spring 60 has a center opening so that the leaf spring fits over pin holder 62 biasing free end 62*a* downwardly. The opposite end of pin holder 62, swivel-mounted end 62*b*, is pivotally mounted to shifter frame 20 by means of pin 62*c* so as to allow free end 62*a* to swivel laterally relative to shifter frame 20 and mounting plate 14 and also to allow free end 62*a* to deflect a small amount vertically. Pin 62*d* is mounted under free end 62*a* so as to depend vertically downwards therefrom. The lower most free end of pin 62*d* is free to move within a wide aperture 20*i* in sub frame 20*c* so that shifter frame 20 does not interfere with the lateral motion of pin 62*d* as it travels within channel guides 64 formed in or mounted on waisted portion 14*c* of mounting plate 14.

Pin 62*d* is resiliently biased in direction J by spring 42 acting on rod 40 and thereby acting on shifter frame 20 to resiliently urge shifter frame 20 in direction A'. Because pin 62*d* is mounted onto shifter frame 20 by means of pins 62*c* and pin holder 62, urging of shifter frame 20 in direction A' thereby also urges pin 62*d* in direction J. Within channel guides 64, an encircling variable-depth channel 64*a* encircles a rigid island 64*b*. Island 64*b* defines a concave cusp 64*c*. When pin 62*d* is positioned against cusp 64*c*, and in particular against the vertex 64*d* of the cusp surface of island 64*b*, spring 42 is compressed and shifter frame 20 is translated into its forward-most position corresponding to when spikes 36 are fully extended. When button 38 is then depressed in direction F, thereby driving rod 40 forwardly relative to mounting plate 14, shifter frame 20 is advanced slightly further forwardly thereby pulling pin 62*d* along with it in a direction opposite to direction J. This forces pin 62*d* in direction K from its position resting against the vertex 64*d* while the base of pin 62*d* rests on step 64*e*. The trajectory of travel of pin 62*d* is governed by the walls of channel 64*a* on step 64*e*. Once pin 62*d* has travelled the length of step 64*e* in direction K, pin 62*d* drops down from step 64*e* onto inclined channel floor 64*f* under the resilient urging of leaf spring 60 acting downwardly on free end 62*a* of pin holder 62.

Thus once button 38 is released so as to allow translation of rod 40 in direction G as spring 42 expands, shifter frame 20 translates in direction A', that is, in a reversed direction to direction A, thereby translating pin 62*d* in direction J so that the base of pin 62*d* follows along the inclined floor 64*f* of channel 64*a*. As shifter frame 20 thus translates rearwardly relative to mounting plate 14, pin 62*d* follows in the trajectory defined by the walls of channel 64*a* to thereby follow around island 64*b* to a position rearmost in channel 64*a* where further rearward translation in direction J of pin 62*d* is halted by pin 62*d* encountering the rearward most curvature position 64*g* of channel 64*a*. At this point pin 62*d* cannot translate in direction J any further and thus rearward translation of shifter frame 20 is halted. This rearward-most position coincides with the rearwardly shifted position of shifter frame 20, that is, coinciding with the fully refracted position of spikes 36.

Upon the next pushing of button 38 in direction F, rod 40 and shifter frame 20 are again translated forwardly and pin 62*d* advances the balance of the path around channel 64*a* and in particular along the balance of the inclined floor 64*f* in direction L whereupon it rounds the forward turn in direction M thereby dropping down from the raised surface of floor 64*f* down onto step 64*h*. From there pin 62*d* returns to its position against vertex 64*d*, again biased in that direction by the operation of spring 42.

Thus as may be seen, because of the lateral width occupied by channel guides 64, where the channels must be sufficiently sized to accept pin 62*d*, and where pin 62*d* must be sufficiently sized so as to be robust to allow longevity of the push button switch operation, it is advantageous to mount channel guides 64 or form channel guides 64 where there is available space on mounting plate 14. Because of the space occupied by the spike actuating mechanisms and spike guides 16, and keeping in mind that it is advantageous in most applications to which sole 10 will be put to maximize the number of spikes 36, the central corridor on heel portion 14*a* may be relatively narrow especially for smaller sized soles 10, thus the relatively open space on waisted portion 14*c* provides the available room on which to mount or form channel guides 64. Because the central portion of shifter frame 20, that is, sub frame 20*c*, transfers the loads in compression and tension as the case may be along two parallel laterally spaced apart rigid stringers 20*j* on opposite sides aperture 20*i* and pin holder 62, the amount by which stringers 20*j* are spaced apart governs the available space within which pin 62*d* may be translated laterally when translating in channel 64*a*.

The waisted portion 14*c* of mounting plate 14 also provides for accommodating the arch of a typical piece of footwear which often dictates the shape of the concavity formed under the arch in the planform of sole 10. In alternative embodiments, if desired, mounting plate 14 may be formed with a slight rocker shape, that is, a slight upward curvature to provide a slightly rockered rigid base under which the resilient portion of sole 10 would be mounted. This may be employed in certain applications of sole 10 where a slightly rockered rigid shape for mounting plate 14*a* is desirable rather than being planar shape. Thus a slight curvature might be introduced for example along the waisted portion 14*c* while maintaining the heel and ball portions 14*a* and 14*b* respectively planer. In order to accommodate the translation of shifter frame 20 in such embodiments, sub frame 20*c* may be provided with one or more pivotable joints for example formed in stringers 20*j* either by the use of pins or by the use of pinned links such as links 54 for example. Thus because shifter frame 20 only has to translate a relatively short distance forwardly and rearwardly relative to mounting plate 14, and because the forward and rearward portions of shifter fame 20 are held by guides 56 flush down against the corresponding portions of mounting plate 14 while still allowing for the relative translation of shifter frame 20 flush over mounting plate 14, such a rocker shape in mounting plate 14, which may be rigid or in alternative embodiments slightly flexible, may be accommodated in alternative embodiments.

Although the structural form described herein of shifter frame 20 is not intended to be limiting, it has been found advantageous to provide the rigid U-shaped collars extending laterally from the longitudinal; back-bone of frame 20 and laterally from toe-shifter frame 52 so that for each spike guide 16 and the related spike actuating linkages on either side of each spike guide 16, a U-shape collar provides for simultaneous actuation of the knee-lever linkages on either side of each spike guide 16. In this fashion, the likelihood of jamming of the linkages is reduced as compared for example to actuating a linkage on only a single side of a spike guide 16. Again, using the U-shaped collar structures lends to the rugged longevity of the shifter frames and spike actuating mechanism, and provides for positive mechanical driving of each spike so as to extend each spike when desired and so as to retract each spike when desired without relying on a small light-weight resilient mechanism such as small springs mounted underneath the user's foot, so that in the present design a single very rugged spring 42 governs the force with which spikes 36 are refracted, the driving force provided by the user against button 38 providing the force to directly and mechanically extend spikes 36.

Figure 21:
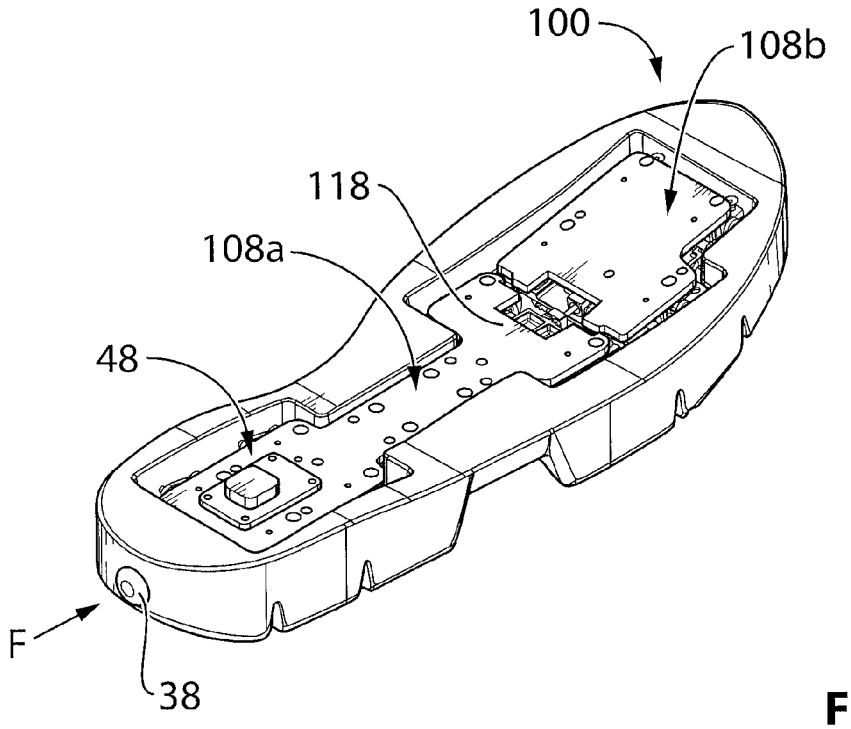
FIG. 21 is, in top rear perspective view, a flexible sole containing the spike actuation assembly according to one embodiment of the present invention.
Figure 22:
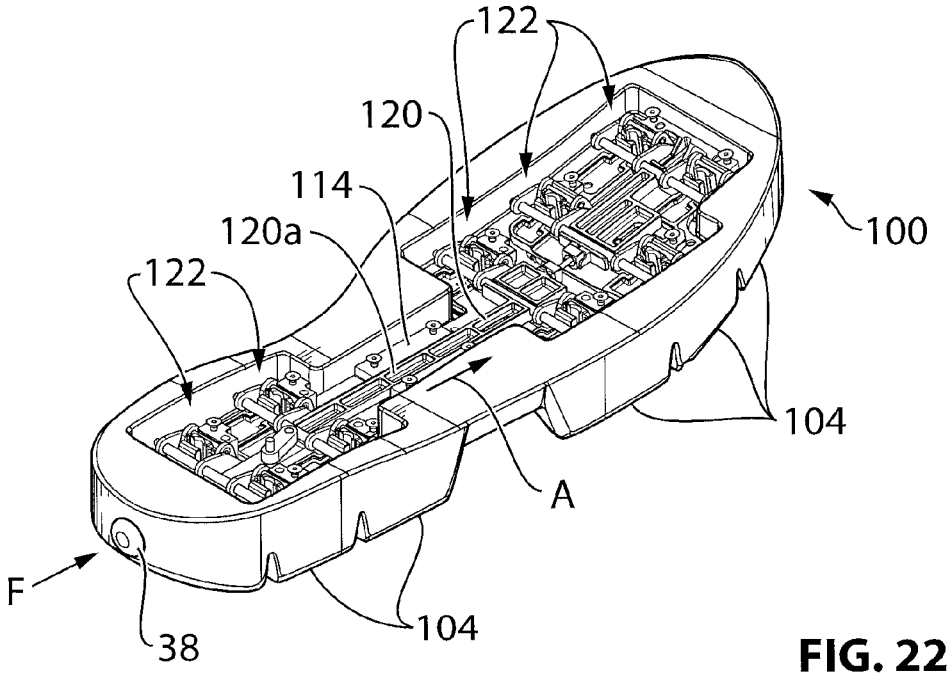
FIG. 22 is the perspective view of FIG. 21 with the top plate of the spike actuation assembly removed and with the upper housing of the push button release mechanism also removed.
Figure 23:
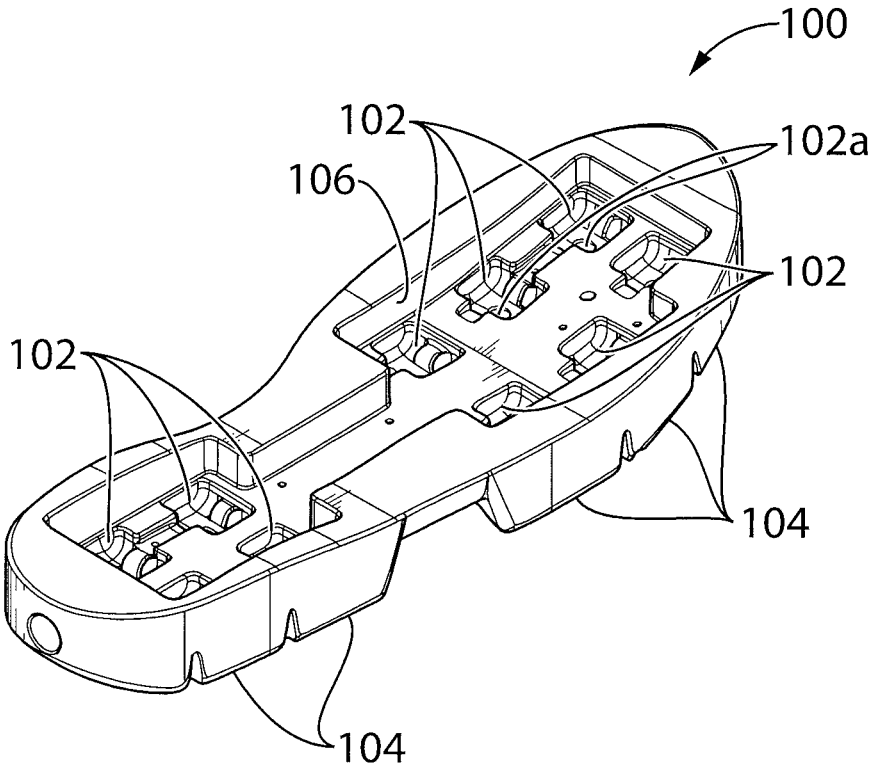
FIG. 23 is the perspective view of FIG. 22 with the spike actuation assembly removed from the sole.

In a low-profile embodiment according to another aspect of the present invention, and as better seen commencing in FIG. 21, sole 100 has cavities or pockets 102 formed into the base of the sole, in one embodiment not intending to be limiting, formed into lugs 104 formed in the sole so that spike guides 116 mounted on a lower mounting plate 114 may protrude downwardly from lower mounting plate 114. This allows for the reduction of the upper elevation of spike guides 116, thereby allowing for the appearance of a lower profile sole 100 when viewed side-on.

Sole 100 which is advantageously made of resilient material so as to be flexible when formed as part of a shoe, boot, or other footwear and worn by a user, has a primary cavity 106 formed in and along substantially the entire length of the sole, sized to snugly fit therein the entire actuable spike assembly 108. Gaskets 110 mount snugly down into the base of pockets 102 so as to align spikes 112 with apertures 102*a* in the bottom surfaces of pockets 102.

Figure 24:
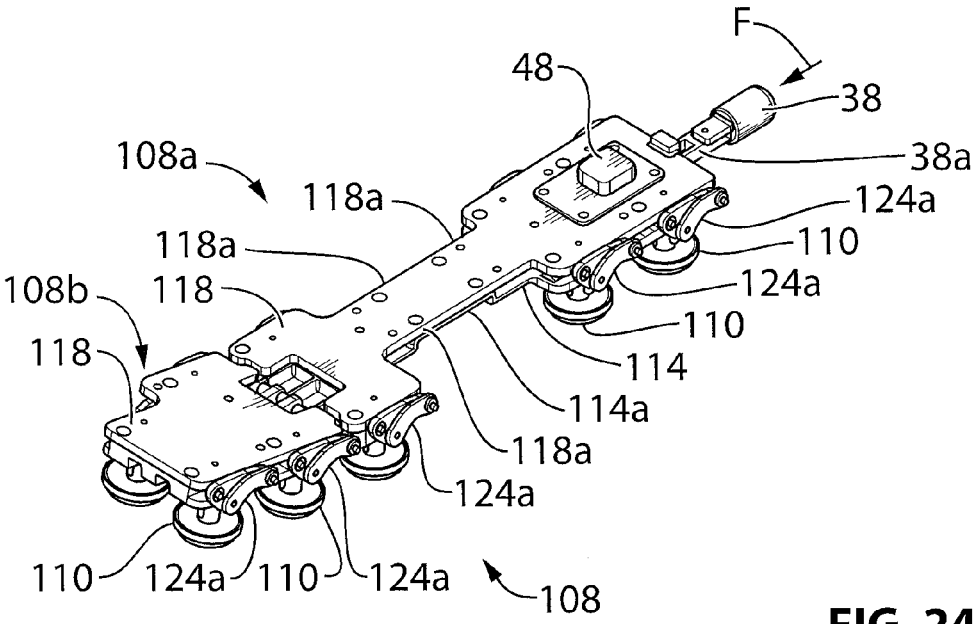
FIG. 24 is, in front top perspective view, the spike actuation assembly of FIG. 21.
Figure 25:
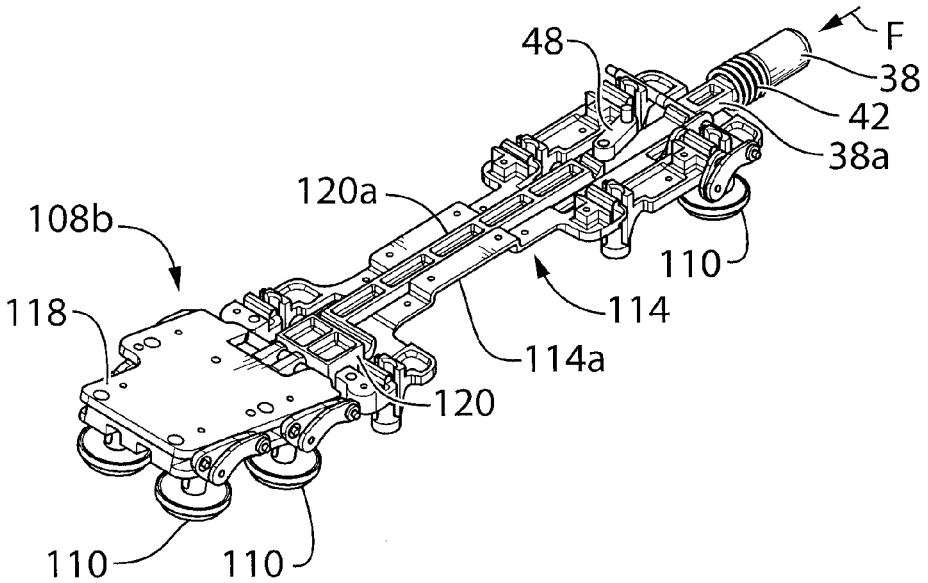
FIG. 25 is the perspective view of FIG. 24 with the top plate of the main spike actuation sub-assembly removed and with the push button release mechanism housing also removed.
Figure 26:
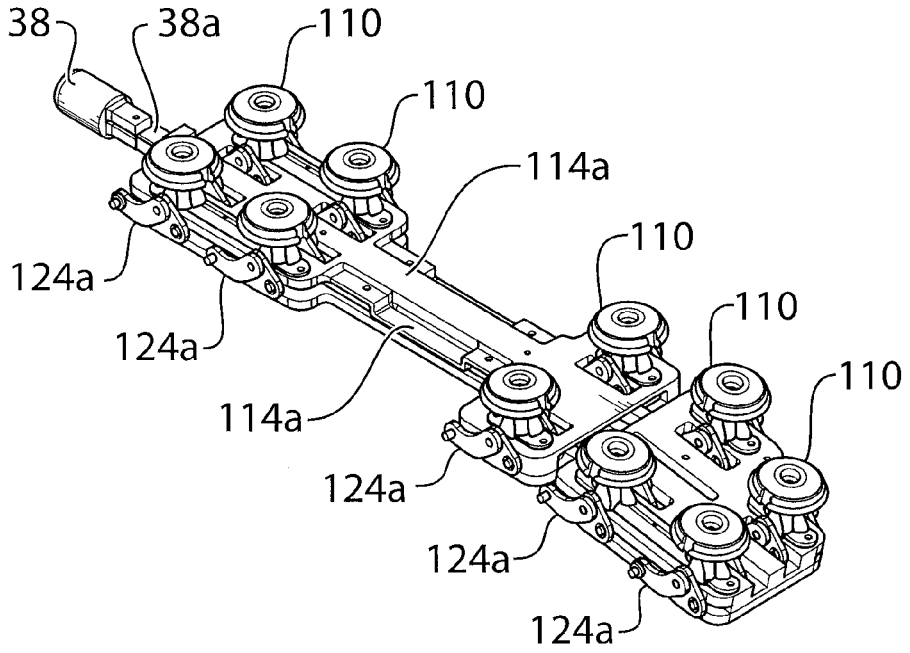
FIG. 26 is, in bottom front perspective view, the spike actuation assembly of FIG. 24.
Figure 27:
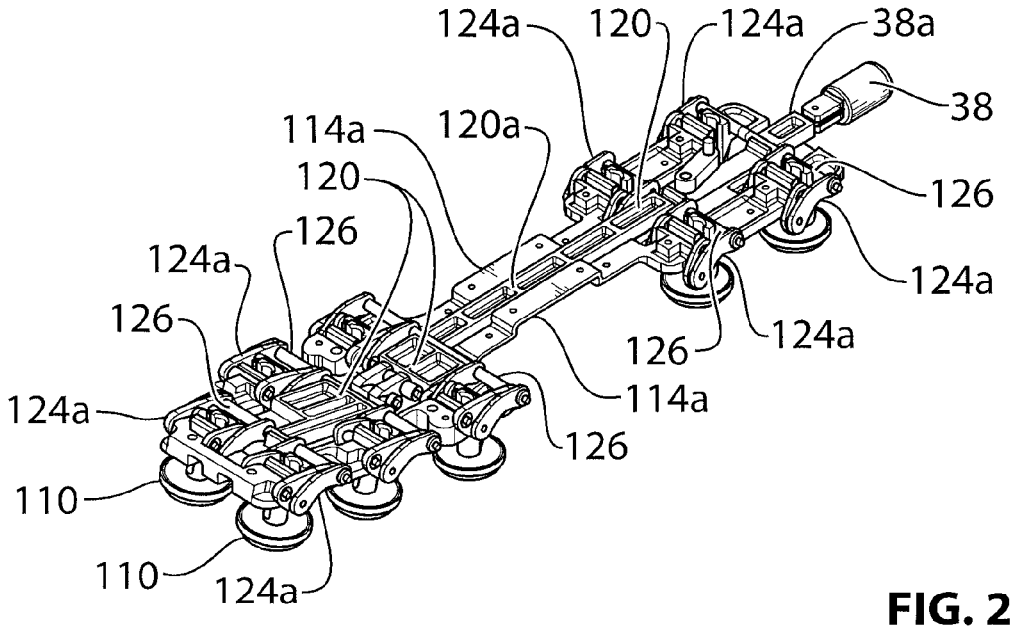
FIG. 27 is the perspective view of FIG. 25 with the top plate on the toe portion spike actuation sub-assembly removed.
Figure 28:
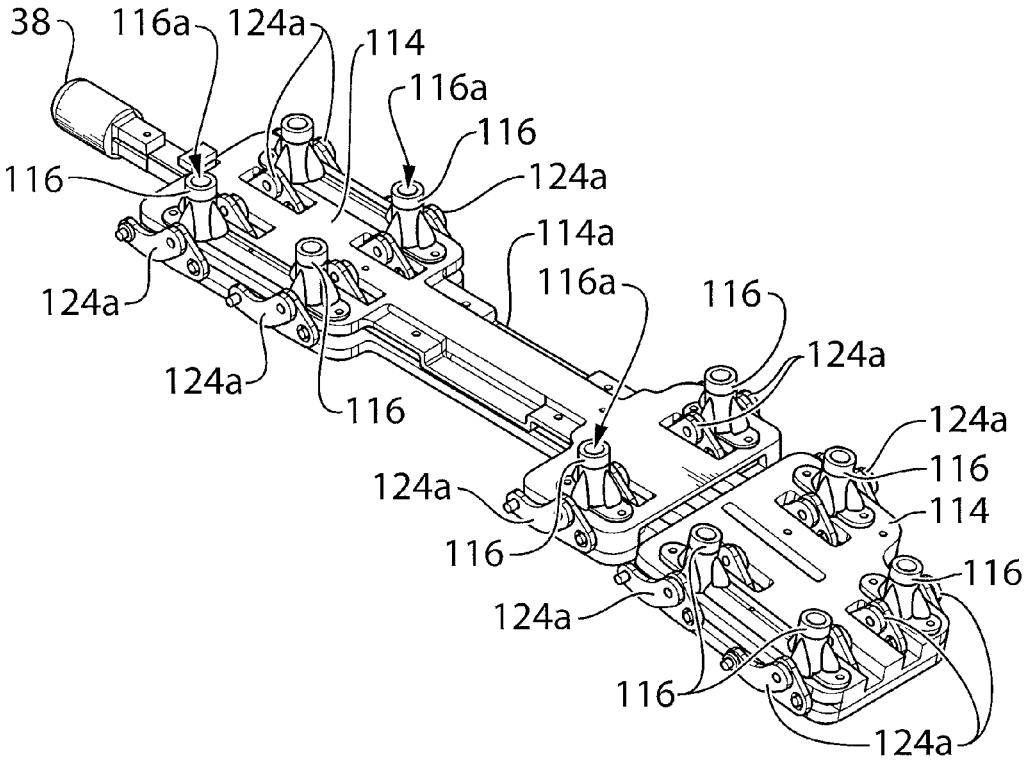
FIG. 28 is the perspective view of FIG. 26 with the gaskets removed from the spike guides.

Top plate 118 is mounted down onto mounting plate 114 so as to sandwich a shifter plate 120 therebetween. Lower mounting plate 114, shifter plate 120, top plate 118, and spike actuation assemblies 122 mounted to plate 114, which cooperate with shifter plate 120 to actuate spikes 112 between their lowered and elevated positions, jointly form spike assemblies 108 as seen in FIG. 24. In one preferred embodiment, an overall actuable spike assembly 108 contains at least two separate spike assemblies, for instance a main spike assembly 108*a* which resides under the heel, arch and ball-of-the-foot of a user, and a toe spike assembly 108*b* which, in cooperation with main spike assembly 108*a*, is positioned substantially under the toes of a user and is free to pivot relative to main spike assembly 108*a* for example during bending of sole 100 while a user is walking wearing footwear containing the present invention.

Main spike assembly 108*a* includes a waisted or narrowed section corresponding to the arch of the foot of a user. In particular, plates 114 and 118, and shifter plate 120 each have correspondingly narrowed sections between the heel and ball-of-the-foot sections of spike assembly 108*a*.

As before, when spike assembly 108 is mounted into the sole button 38 is positioned at the aft end of the heel of sole 100. Button 38 is actuable by a user kicking or pushing the button against a hard surface so as to drive the button and a drive coupling or shaft 38*a* in direction F against the return biasing force of a resilient return mechanism such as, by way of example, helical coil spring 42. As before, spring 42 may be mounted journalled over shaft 28*a*. Button 38 is mounted by shaft 38*a* to the aft end of shifter plate 120 so that when button 38 is driven in direction F, shifter plate 120 is driven in direction A longitudinally along substantially the center line of plates 114 and 118. Plates 114 and 118 are mounted to each other for example, without intending to be limiting, on raised lands on plate 114 in the front and aft sections and in the waisted section between the front and aft sections of main spike assembly 108*a* by means of an upset 114*a* formed lower mounting plate 114. Fasteners 118*a* mount upset 114*a* to the underside of plate 118 in the waisted portion of plate 118, and mount top plate 118 down onto the raised lands on mounting plate 114 in the fore and aft sections of assembly 108*a* and in assembly 108*b*. The plates 114 and 118 so mounted to each other form a tunnel therebetween, plate 118 providing a cover on top of a channel formed in plate 114. Narrow slide portion 120*a* of shifter plate 120 snugly slides in the tunnel to act as a push/pull rod. Slide portion 120*a* is supported and guided within, so as to snugly slide along the channel formed in upset 114*a*, that is, in the tunnel between the plates 114 and 118. Slide portion 120*a* links the spike actuation assemblies 122 in the heel or aft portion of spike assembly 108*a* with the spike actuation assemblies 122 in the forward or ball-of-the-foot portion of spike assembly 108*a*.

With the spike guides 116 recessed so as to protrude downwardly from the bottom of lower mounting plate 114, the geometry of each linkage assembly 124 in spike actuation assemblies 122 transmits the longitudinal driving motion of the shifter plate 120 into vertical, or substantially vertical translation of spikes 112 sliding up and down in the spike guides 116. As before, a plurality of linkage arms (124*a*, 124*b*, and 124*c*) forming a knee-lever linkage mounted in parallel pairs, laterally spaced apart on either side of each spike guide 116 are arranged so that, with the spikes 112 in their extended (lowered) position, two of the linkage arms (124*b*, 124*c*) are substantially aligned along axis E as seen in FIG. 29 so that an upward force in direction D' acting on the spikes is transmitted into spike guides 116 rather than into the shifter plate 120.

Figure 29:
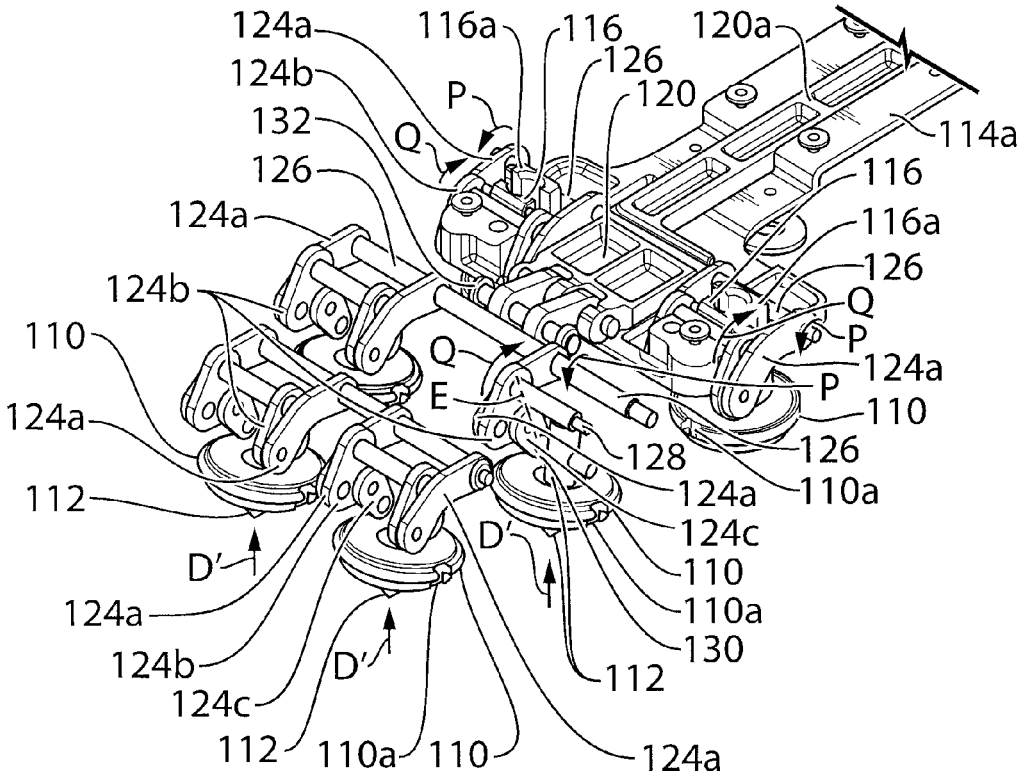
FIG. 29 is a partially cut-away, enlarged view of the front of the spike actuation assembly of FIG. 27.
Figure 29A:
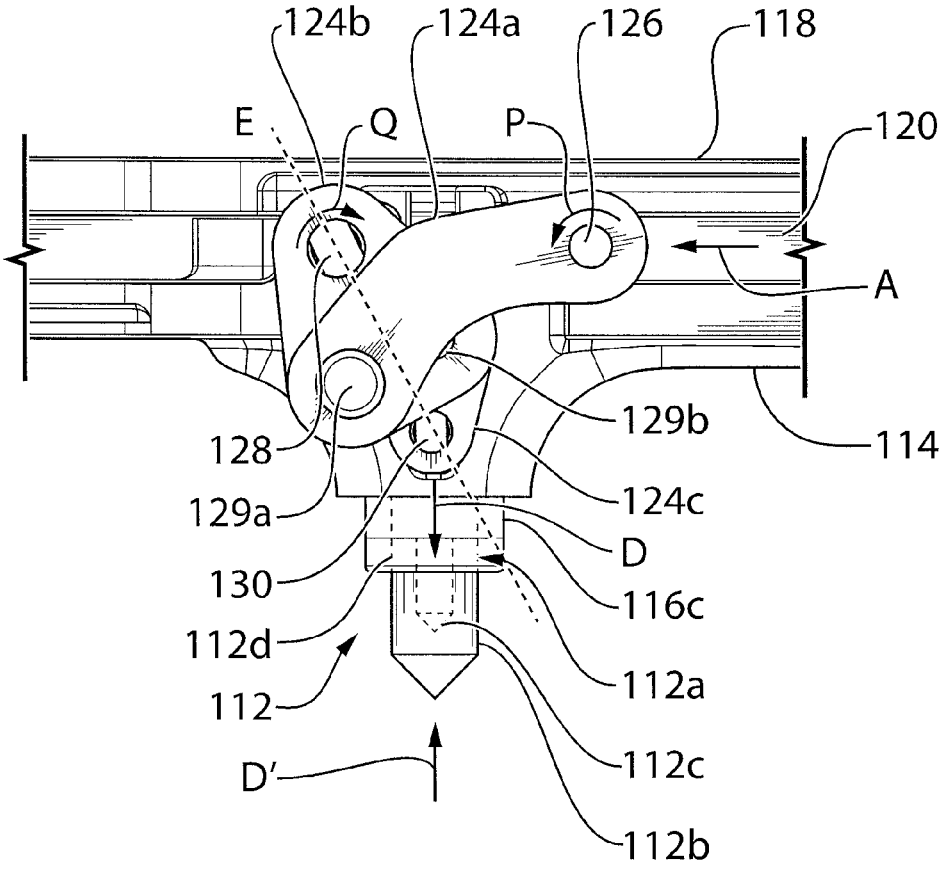
FIG. 29*a* is, in partially cut-away side elevation view, one of the knee linkage assemblies of FIG. 29 showing a spike in its lowered fully extended position.
Figure 29B:
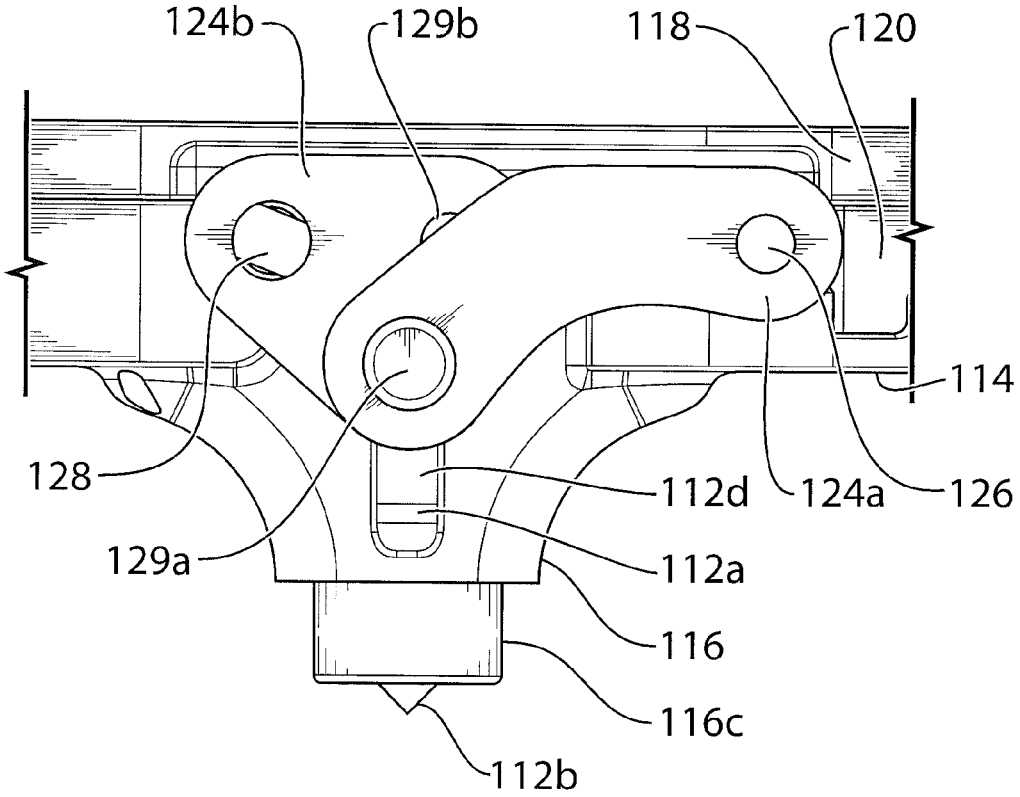
FIG. 29*b* is the side elevation view of FIG. 29*a* with the spike in its fully elevated refracted position.
Figure 30:
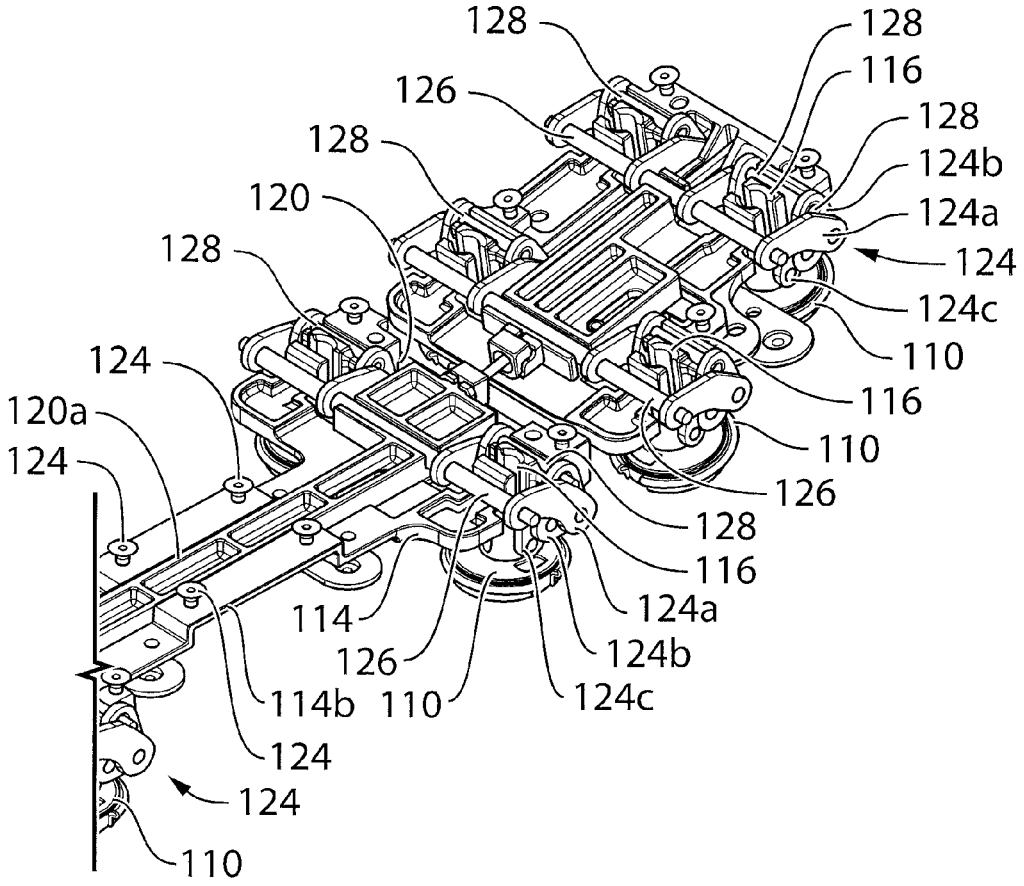
FIG. 30 is, in top rear perspective view, an enlarged partially cut-away portion of the spike actuation assembly of FIG. 27.
Figure 31:
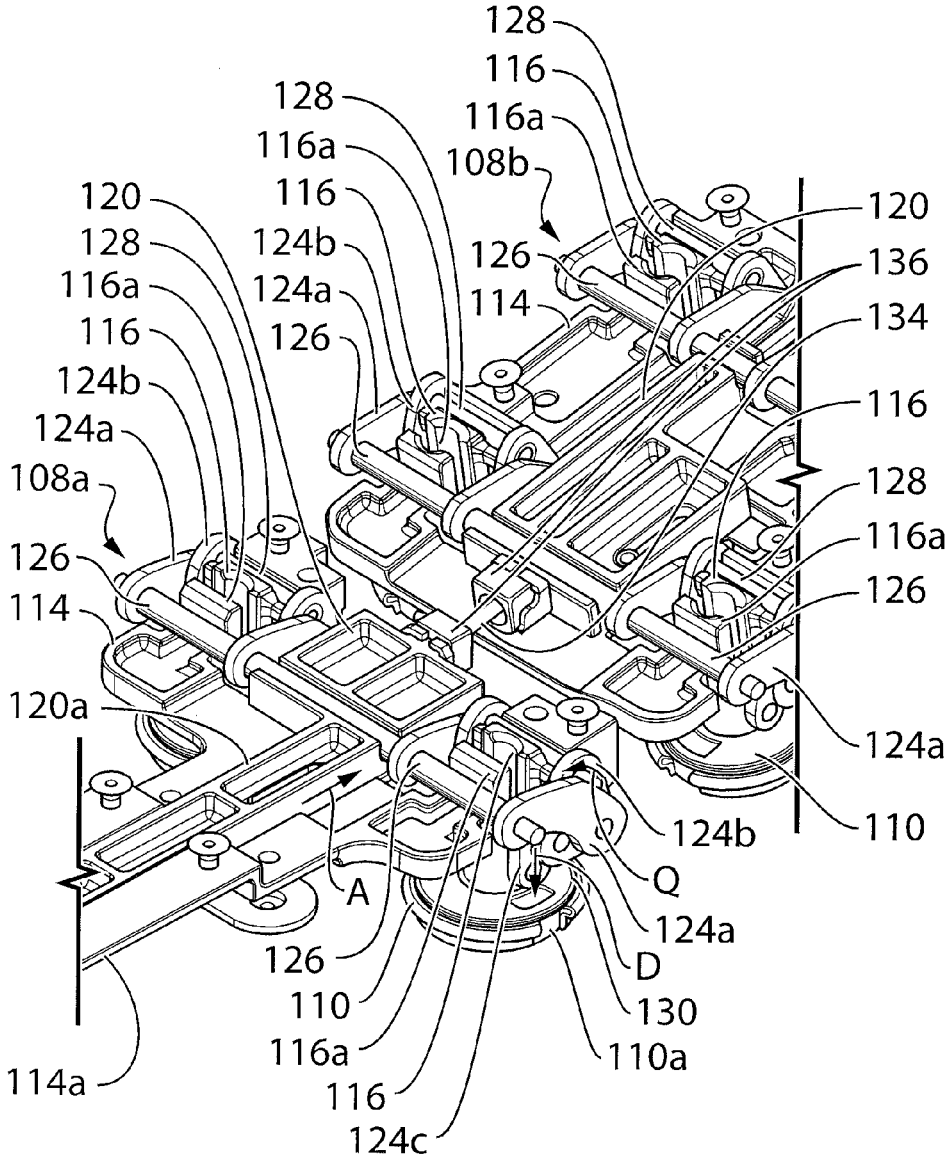
FIG. 31 is a further enlarged view of the perspective view of FIG. 30.
Figure 32:
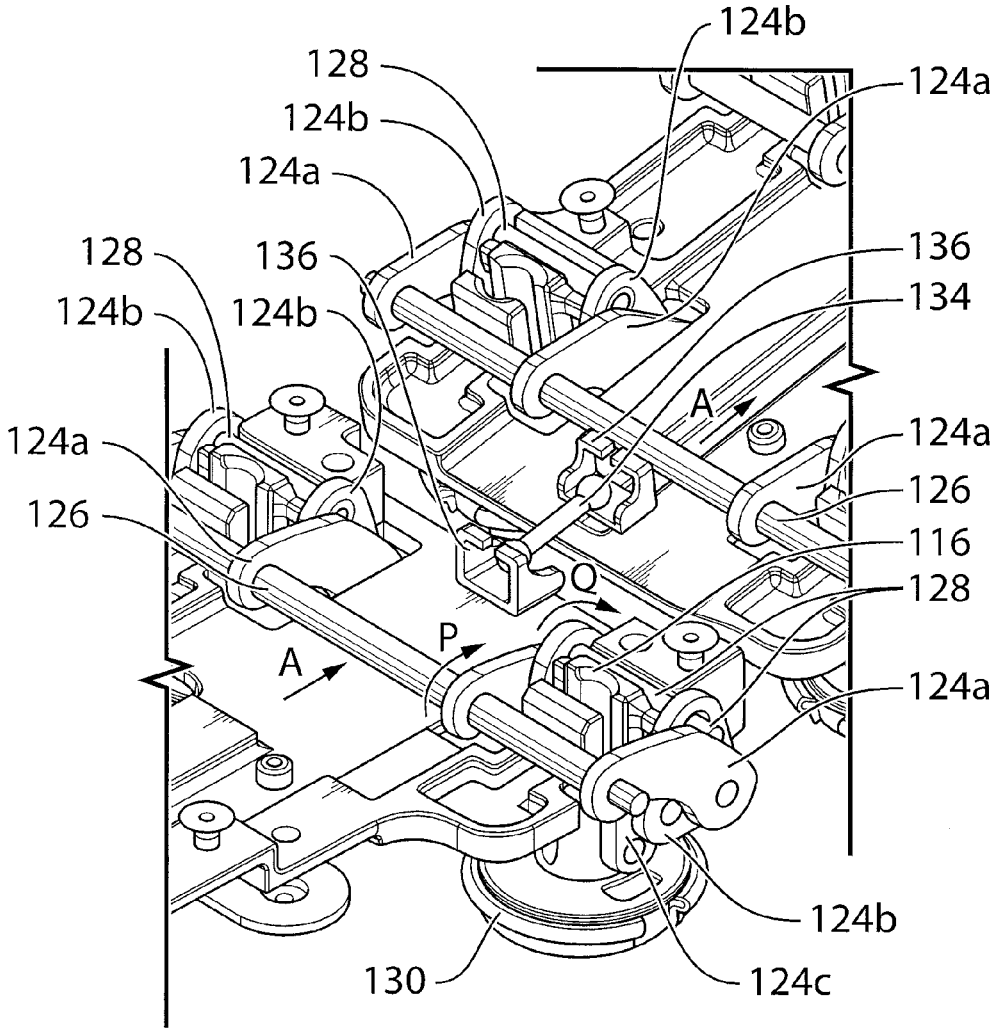
FIG. 32 is a further enlarged view of the pivotting linkage between the main and toe portion spike actuation sub-assemblies partially cut-away pair of ball joints on opposite ends of the linkage drive shaft.
Figure 33:
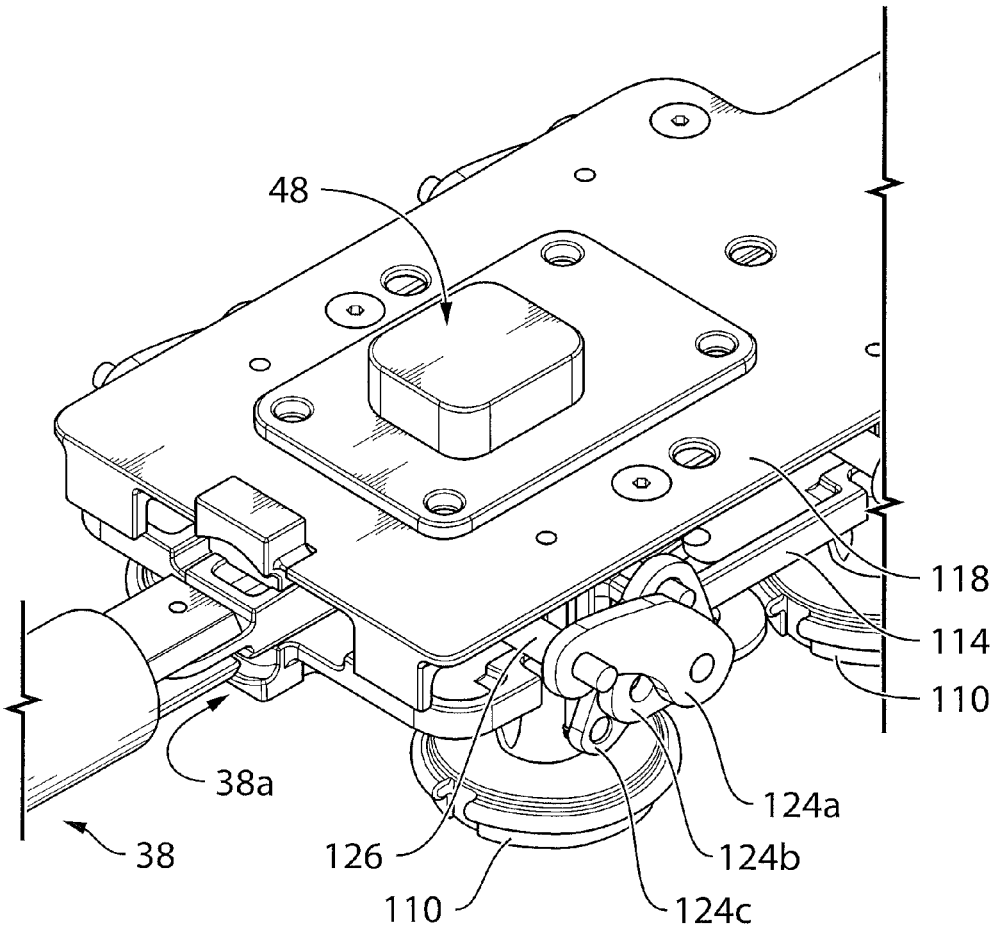
FIG. 33 is and enlarged view of the heel portion of the spike actuation assembly of FIG. 21.

Again, shifter plate 120 and its corresponding linkage arm 124*a*, is employed primarily to substantially maintain the alignment between linkage arms 124*b* and 124*c* so as to transmit the upward force from the spike to the spike guide along substantially axis E as seen in FIGS. 29 and 29*a* rather than into the shifter plate where the force may otherwise cause the shifting mechanism to slow or bind or cause damage to the shift button release mechanism 48. Thus for example if a heavy user wearing footwear incorporating the spike actuation mechanism of the present invention is standing and the spikes are extended from beneath the soles of the footwear for traction, without the knee linkage of linkage arms 124*a*, 124*b*, and 124*c* or other functionally equivalent structure the upward force on the spikes resulting from the user's weight would in part transfer upwardly into shifter plate 120, and shifter plate 120 may (1) then consequently be driven upwardly into frictional engagement upwardly against the underside of the top plate 118 resulting in friction which may make shifter plate 120 resistant to sliding and so may interfere with the operation of the retraction of the spikes as the return biasing force of spring 42 may not be sufficient to overcome the friction resisting the aft sliding of shifter plates 120; and, (2) be pushed backwards (opposite direction A) towards the heel and thereby place a load on the relatively delicate operation of the push button release mechanism 48 described above and located in this embodiment at the heel, thereby causing the switch track mechanism within release mechanism 48 to deform, possibly breaking the pin and toggle. The knee linkage thus protects the switch mechanism of release mechanism 48.

With spikes 112 in their elevated or refracted position, as shifter plate 120 is driven forward in direction A, laterally extending cross-members 126 mounted in, so as to extend laterally from, shifter plate 120, are also driven forward. Outer linkage arms 124*a*, pivotally mounted on cross-members 126 are rotated downwardly in direction P thereby driving downward rotation of mid-linkage arms 124*b* in direction Q about pins 128. Mid linkage arms 124*b* are pivotally mounted at their upper ends on pins 128 and at their lower ends are pivotally mounted to arms 124*a* by pins 129*a*. Pins 128 are mounted in, so as to extend laterally across, the upper ends of spike guides 116. Inner linkage arms 124*c* are pivotally mounted, at one end, to the lower ends of mid linkage arms 124*b* by means of pins 129*b*, and at their opposite ends to pins 130. Pins 130 are mounted to, so as to extend laterally from, spikes 112, and positioned approximately two-thirds of the way up the length of each spike. As before, each spike 112 is constrained for vertical translation being mounted within, so as to slide along vertical, or substantially vertical, elongate generally cylindrical hollow bores 116*a* formed in spike guides 116.

Figure 34:
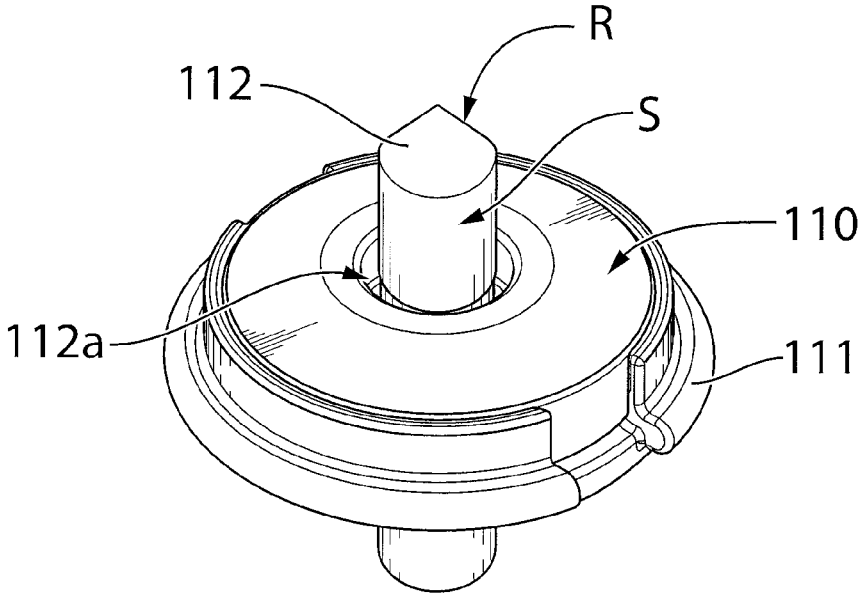
FIG. 34 is a bottom perspective view of one embodiment of the spike gaskets according to the present invention showing a spike extending therethrough.
Figure 34A:
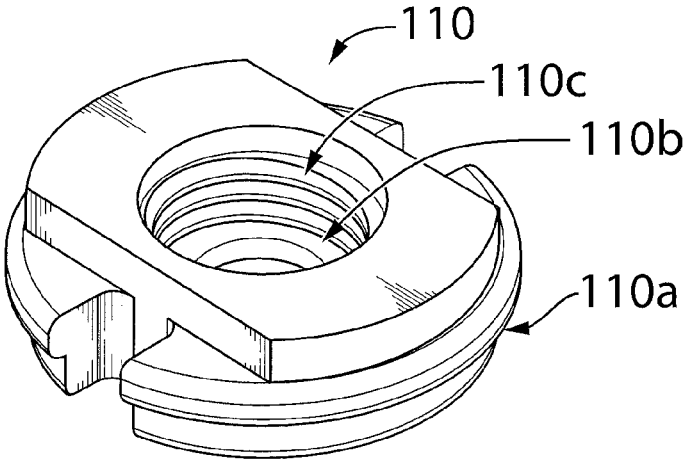
FIG. 34*a* is, in bottom perspective view, a further embodiment of a spike gasket according to the present invention.
Figure 34B:
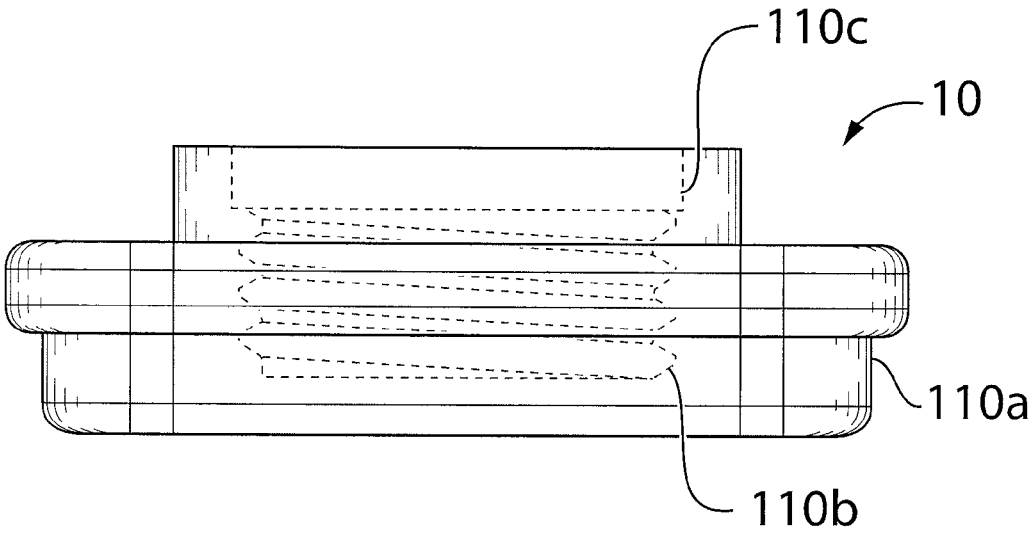
FIG. 34*b* is, in side elevation view, the spike gasket of FIG. 34*a*.

With the spike guides 116 embedded substantially midway along their vertical length into the lower mounting plate 114 so that the spike guides protrude upwardly and downwardly from the lower mounting plate, the spike guides can thereby be, and are, more robustly supported to resist a force, for example in direction R, causing a bending moment imparted to spike guides 116 by spikes 112 when they are in their extended position. For example, with the spikes extended, when a user twists the user's foot while the spikes are engaged with the ground, such a motion will impart a torque to the spikes, and consequently to corresponding spike guides 116, tending to twist the spike guides relative to the lower mounting plate. Such a torque applied by the user to the spikes when in their extended position is resisted in one embodiment (FIG. 34) by gasket 110 mounted in the bottom of the corresponding pocket 102 in sole 100 so as to protrude the base of the gasket and in particular its hard shell housing 111 from apertures 102*a* in the pockets.

In a preferred embodiment, each spike is notched with an annular groove 112*a* such as seen in FIG. 29*a* or a like mechanical arrangement to provide for shearing of the spike, for example, so as to shear flush with the bottom of sole 100 upon excessive sideways force for example in direction R being applied to the end of the spike. In a preferred embodiment each spike 112 has a replaceable tip 112*b*, for example threadably mounted on threaded shaft 112*c* (shown in dotted outline in FIG. 29*a*) to the corresponding spike base 112*d* at a joint co-located with annular groove 112*a*.

The use of top plate 118 which sandwiches shifter plate 120 between top plate 118 and lower mounting plate 114 also lends to the rigidity of the structure supporting the spike guides 116, for example, where lands 116*b* onto which plate 118 is fastened form part or the top of spike guides 116 such a use of lands 116*b* increases the structural resistance of spike guides 116 to torque applied to spikes 112 when in their extended position and provides further rigidity to resist upward force applied to the spikes in direction D', for example, when a user walks on or jumps down onto hard ground with the spikes extended.

The separate spike actuation assemblies cooperate with each other for simultaneous actuation of spikes 112 from the bottom of sole 100. For example, assembly 108*a* cooperates with assembly 108*b* so that the shifter plate 120 in each assembly is simultaneously shifted forward (direction A) or rearwards by the use of a drive linkage extending between the assemblies which may be in one embodiment a hinge linkage 132, or in another embodiment, neither intending to be limiting, a rigid linear linkage member 134 mounted between adjacent shifter plates 120 at one or both ends of linkage member 134 by for example a ball joint 136 or other universal joint on the corresponding ends of the adjacent shifter plates. A universal joint embodiment permits three degrees of rotational freedom of motion and two degrees of lateral freedom of motion between assemblies 108*a* and 108*b*. Thus in the illustrated embodiment, the linkage member is pivotally mounted to the forward end of the shifter plate 120 within assembly 108*a*, and is pivotally mounted at the other end of the linkage member to the aft end of the shifter plate 120 in the assembly 108*b*. This then transmits the sliding motion of the shifter plate under the foot of the user forward from the ball-of-the-foot to the adjacent toe assembly 108*b* irrespective of the orientation of the toe assembly 108*b* relative to the main assembly 108*a*. Thus even when the user has the sole 100 bent, for example, when the footwear is flexed as the user is walking or running, the pivotable mounting of assembly 108*b* to assembly 108*a* and the pivotal mounting of the linkage member (132, 134) between assemblies 108*a* and 108*b* accommodates the flexing of the footwear, both up and down and laterally in the universal joint or ball joint (that is, three degrees of motion embodiment), and may even provide for the extension or retraction of the spikes while the sole is non-planar, that is also while flexed.

In a preferred embodiment gaskets 110 have a hard shell of plastic or rubber or like material. Shell 110*a* houses an internal soft rubber membrane 110*b* for example that looks like a rubber washer. Shell 110*a* protrudes though apertures 102*a* in pockets 102 and contact the ground so as to provide durability. Shell 110*d* fits closely to spike 112 to keep large particles out but is not intended to actually touch the spike because that may increase the friction. Tolerances may mean this is not always the case. Fine particles and water will be able to pass by the hard shell 110*a* but will be blocked from entry into pockets 102 by the soft gasket 110*b*.

In a preferred embodiment gaskets 110 threadably mount on threads 110*c* onto corresponding downwardly extending threaded ends 116*b* of spike guides 116.

Figure 2:
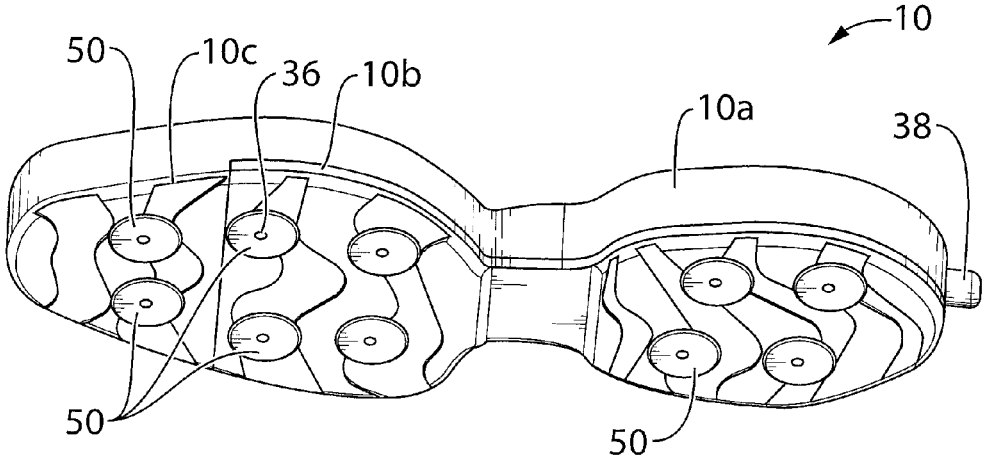
FIG. 2 is a bottom perspective view of the sole of FIG. 1.
Figure 3:
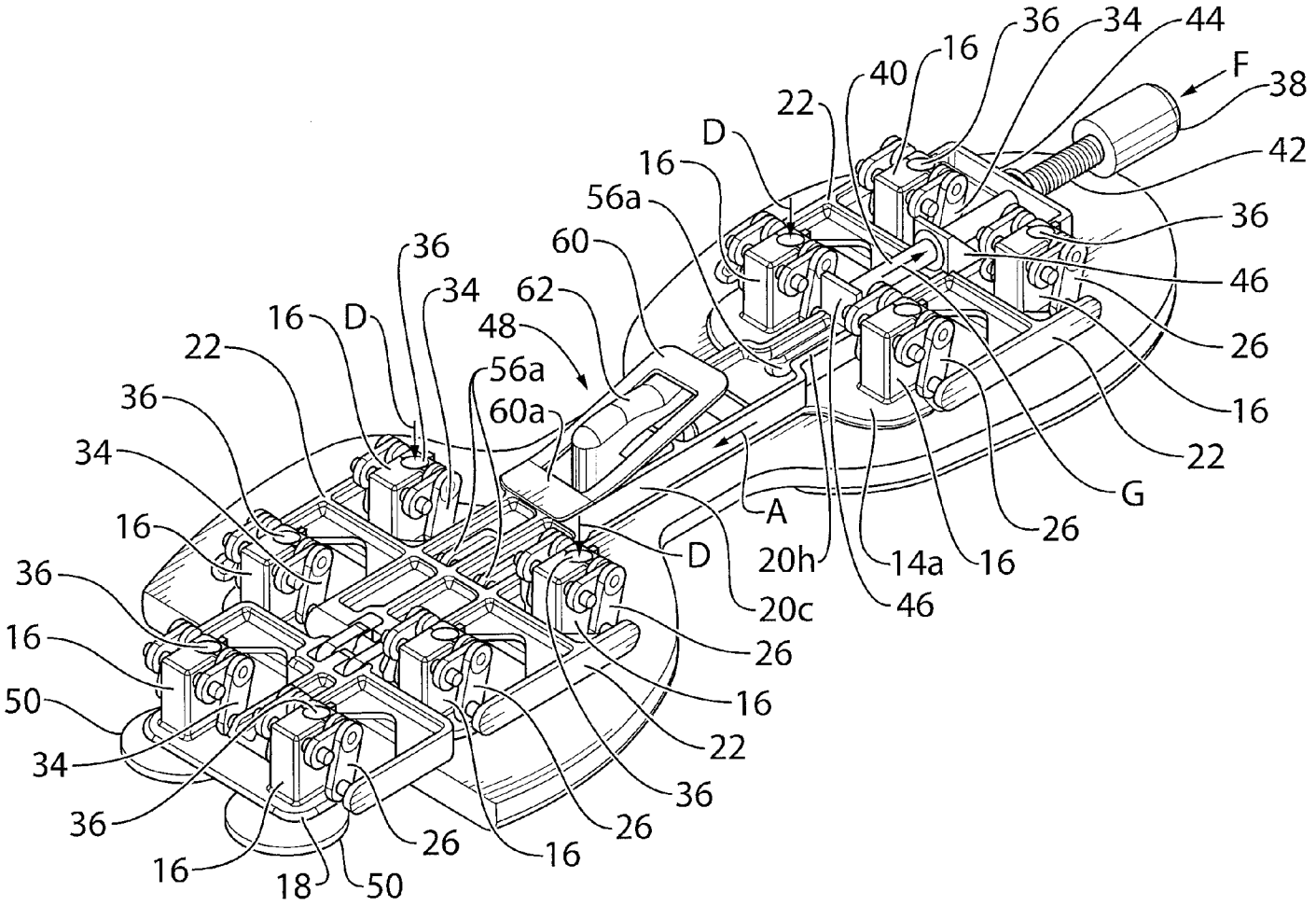
FIG. 3 is, in front perspective view the spike actuating mechanism of FIG. 1 mounted to the under-sole.
Figure 4:
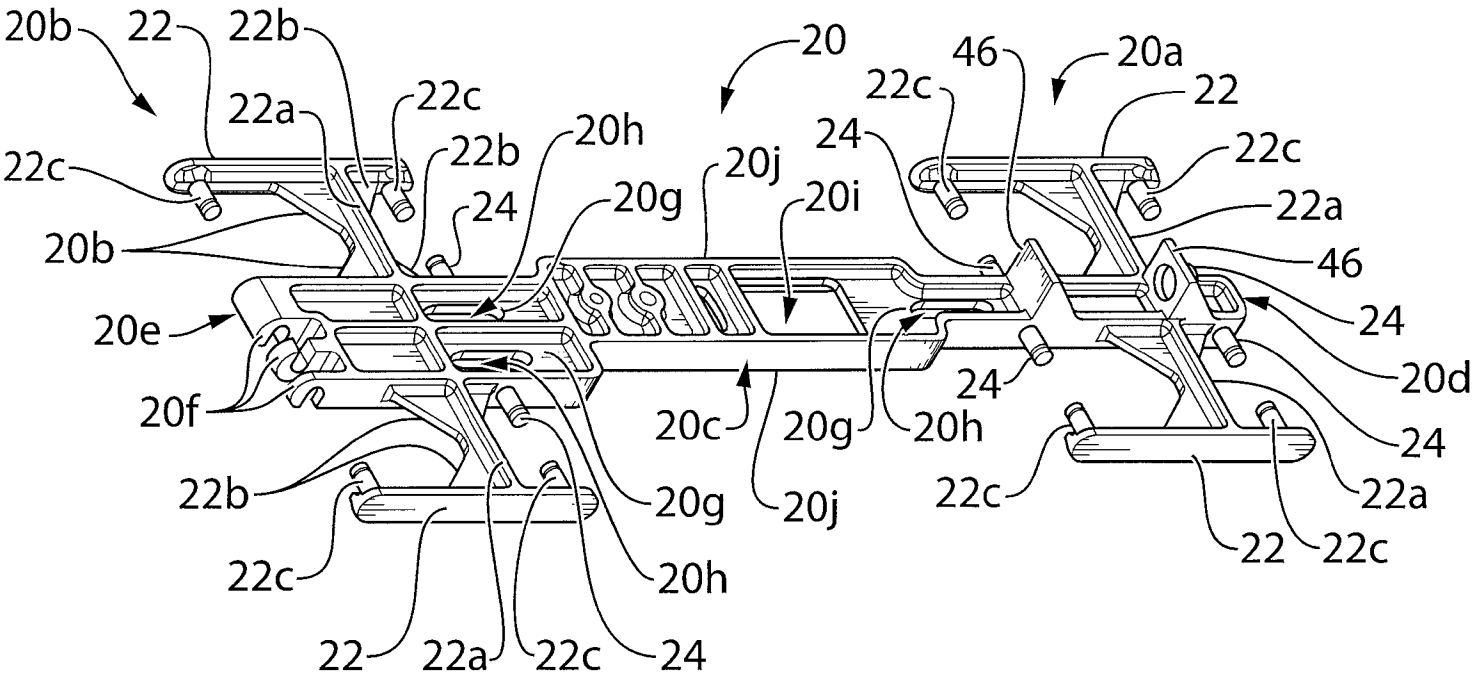
FIG. 4 is, in front perspective view, the shifter frame of FIG. 3.
Figure 5:
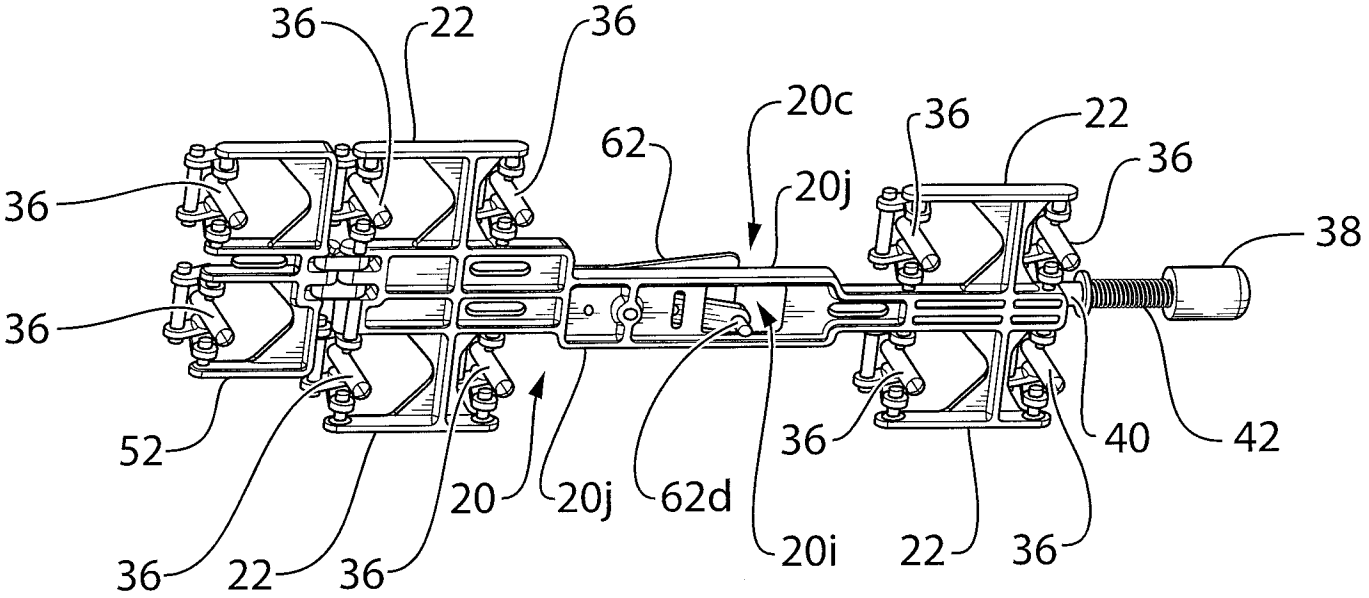
FIG. 5 is, in bottom perspective view, the shifter frame of FIG. 4 showing the pins and pin holder of the push button actuating mechanism mounted thereto.
Figure 6:
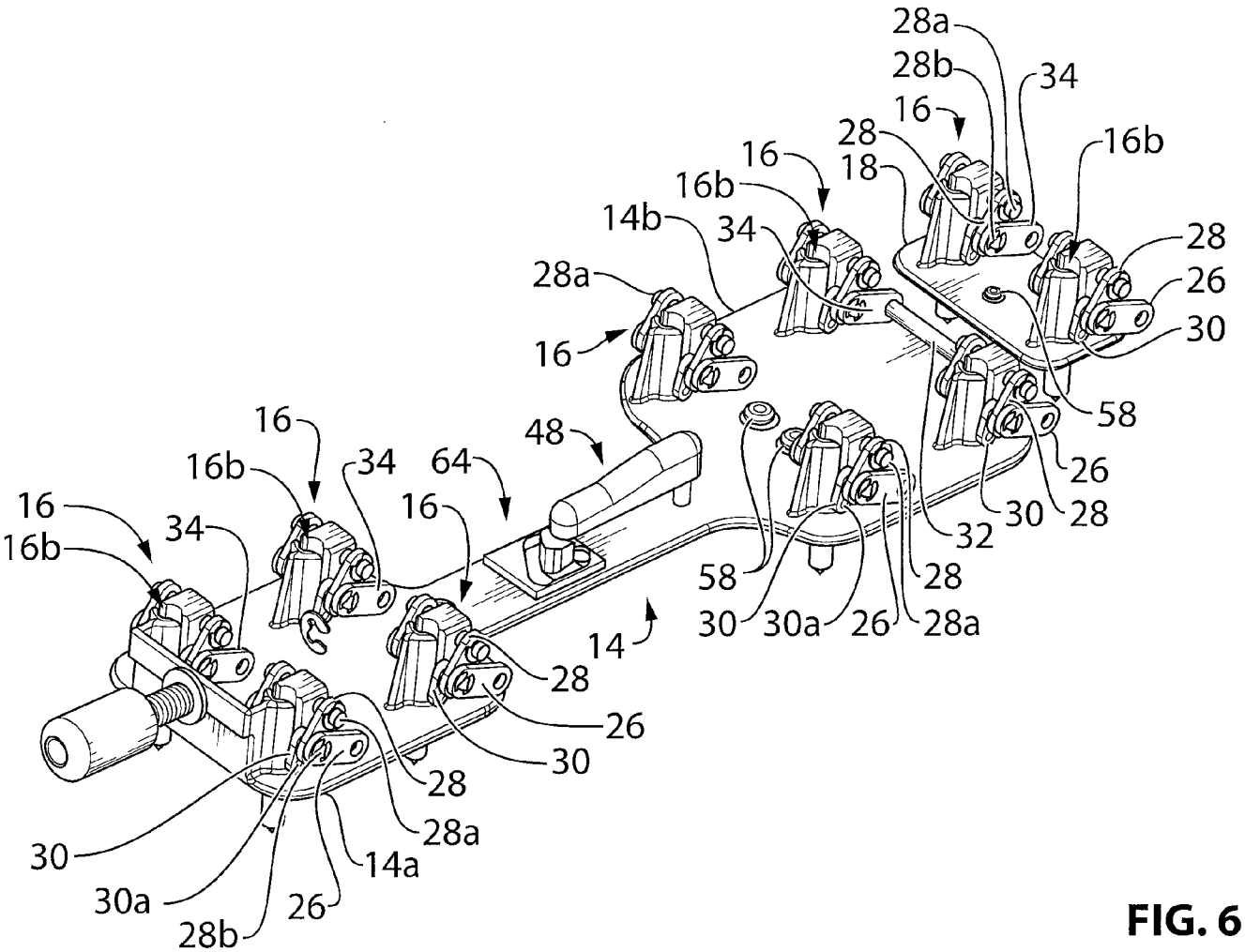
FIG. 6 is, in rear perspective view, the spike actuating mechanism of FIG. 3 with the under-sole, spike gaskets, shifter frame, and actuating rod removed.
Figure 7:
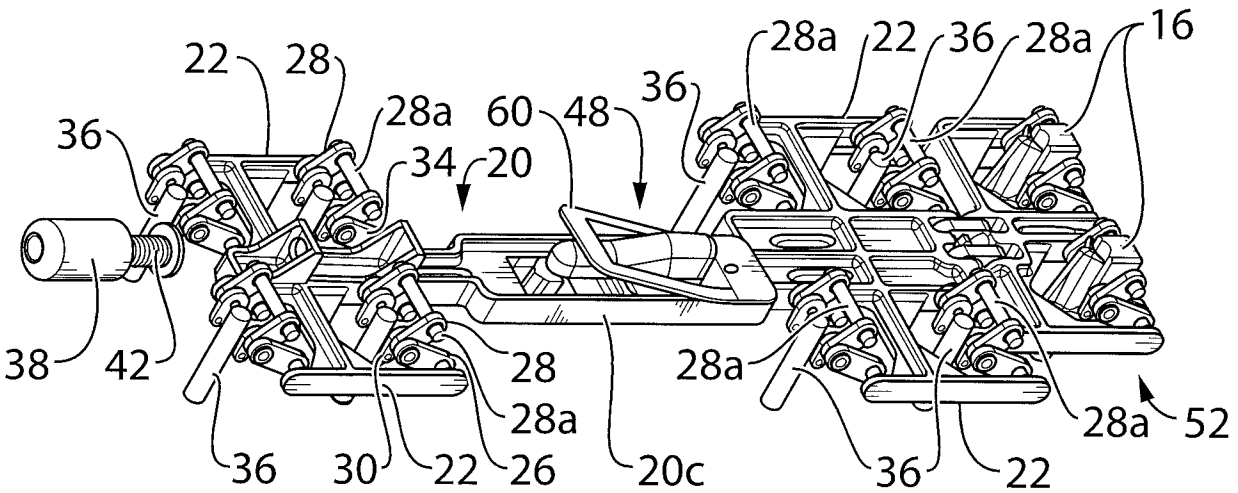
FIG. 7 is the view of FIG. 6 with the shifter frame and leaf spring shown and with the mounting plate removed.
Figure 8:
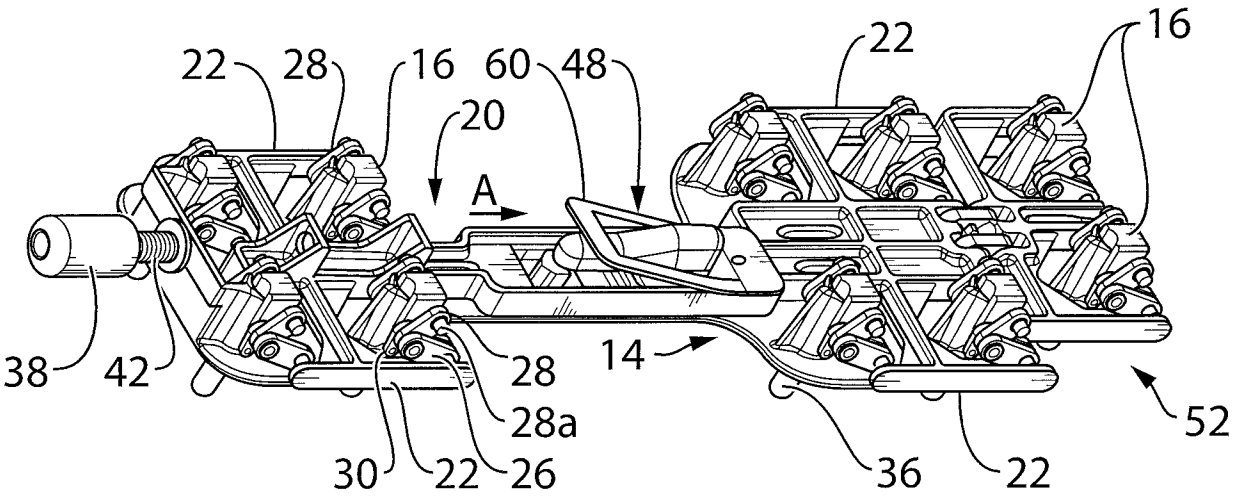
FIG. 8 is the combined views of FIGS. 6 and 7 with the shifter frame mounted overlaying the mounting plate.
Figure 9:
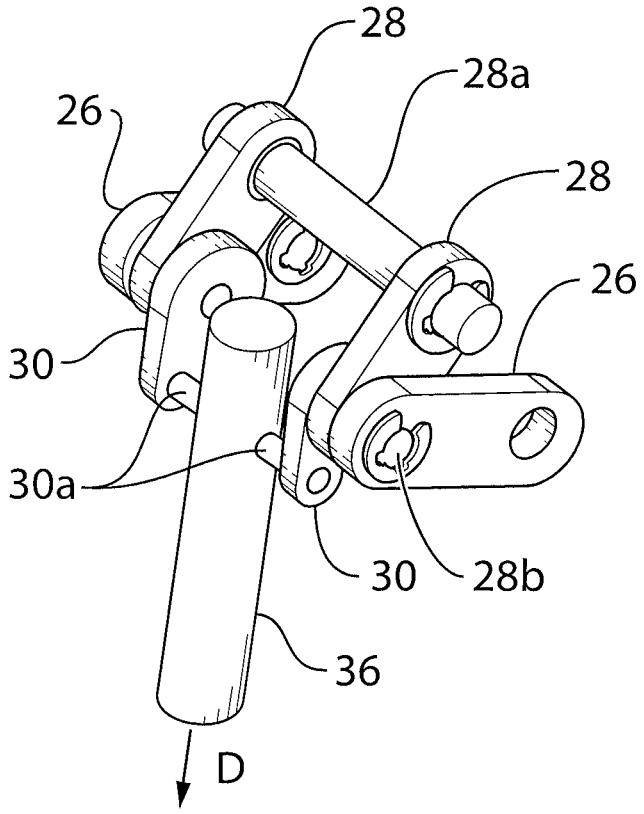
FIG. 9 is, in enlarged perspective view, one of the knee-link assemblies and its corresponding spike taken from FIG. 7.
Figure 10:
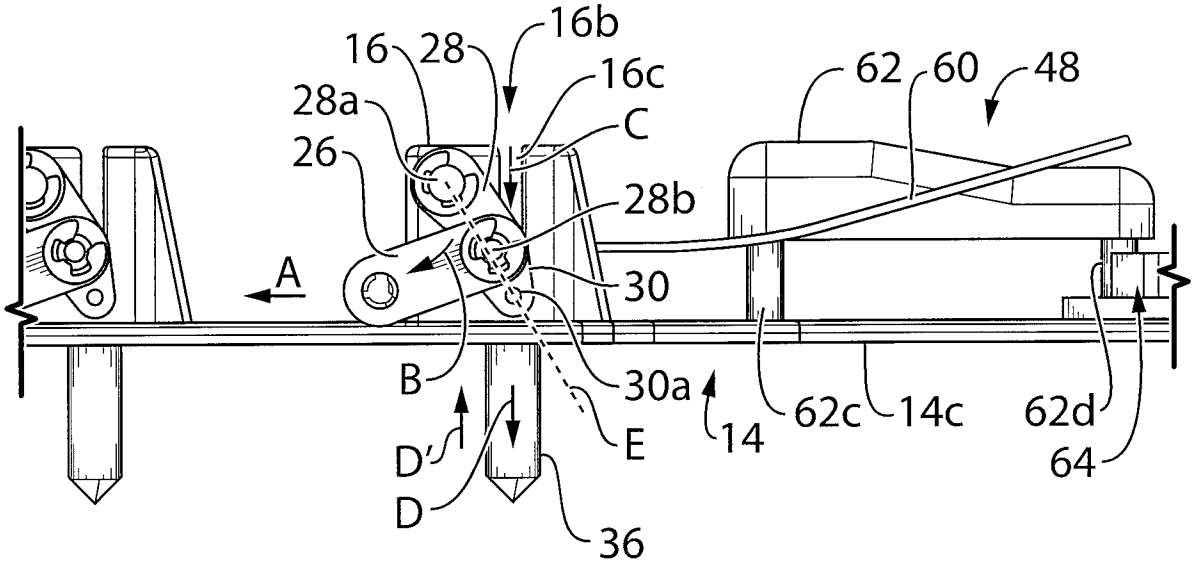
FIG. 10 is, in side elevation view, an enlarged portion of the spike actuating mechanism of FIG. 6.
Figure 11:
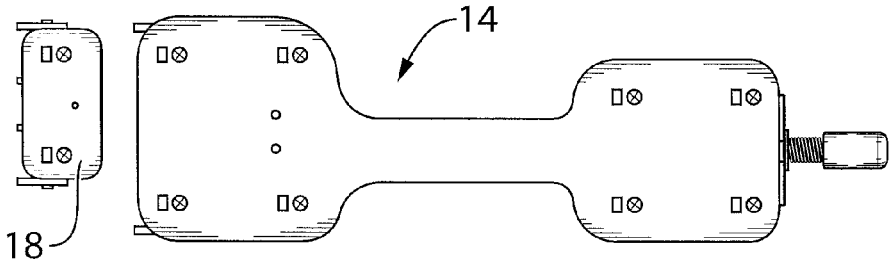
FIG. 11 is, in bottom view, the spike actuating mechanism of FIG. 6.
Figure 12:
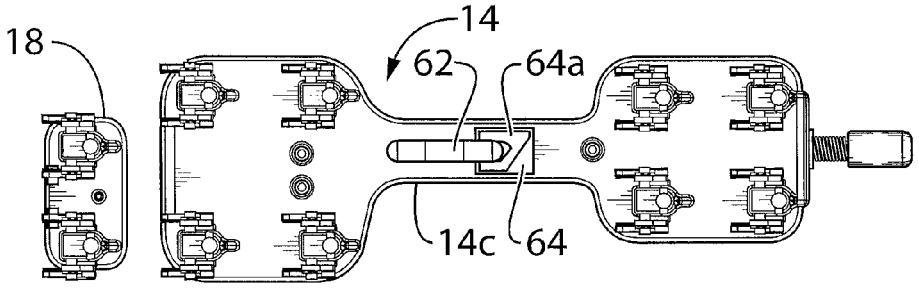
FIG. 12 is, in plan view, the spike actuating mechanism of FIG. 11.
Figure 13:
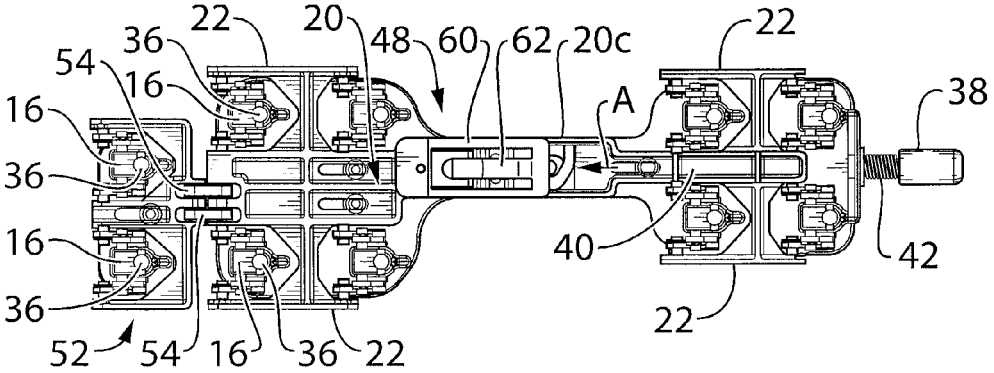
FIG. 13 is, in plan view, the spike actuating mechanism of FIG. 8.
Figure 14:
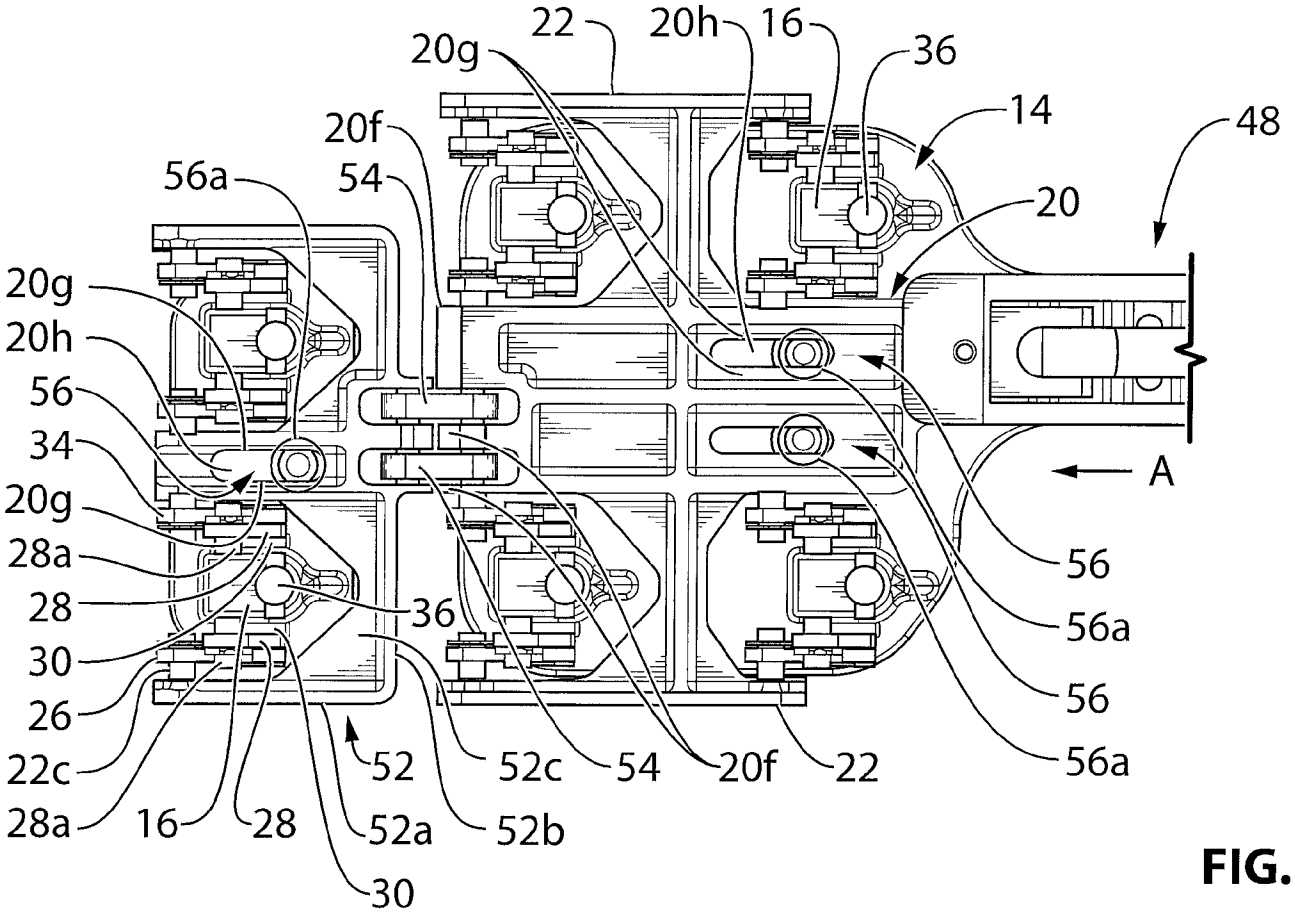
FIG. 14 is, in plan view, an enlarged view of the front end of the spike actuating mechanism of FIG. 13.
Figure 15:
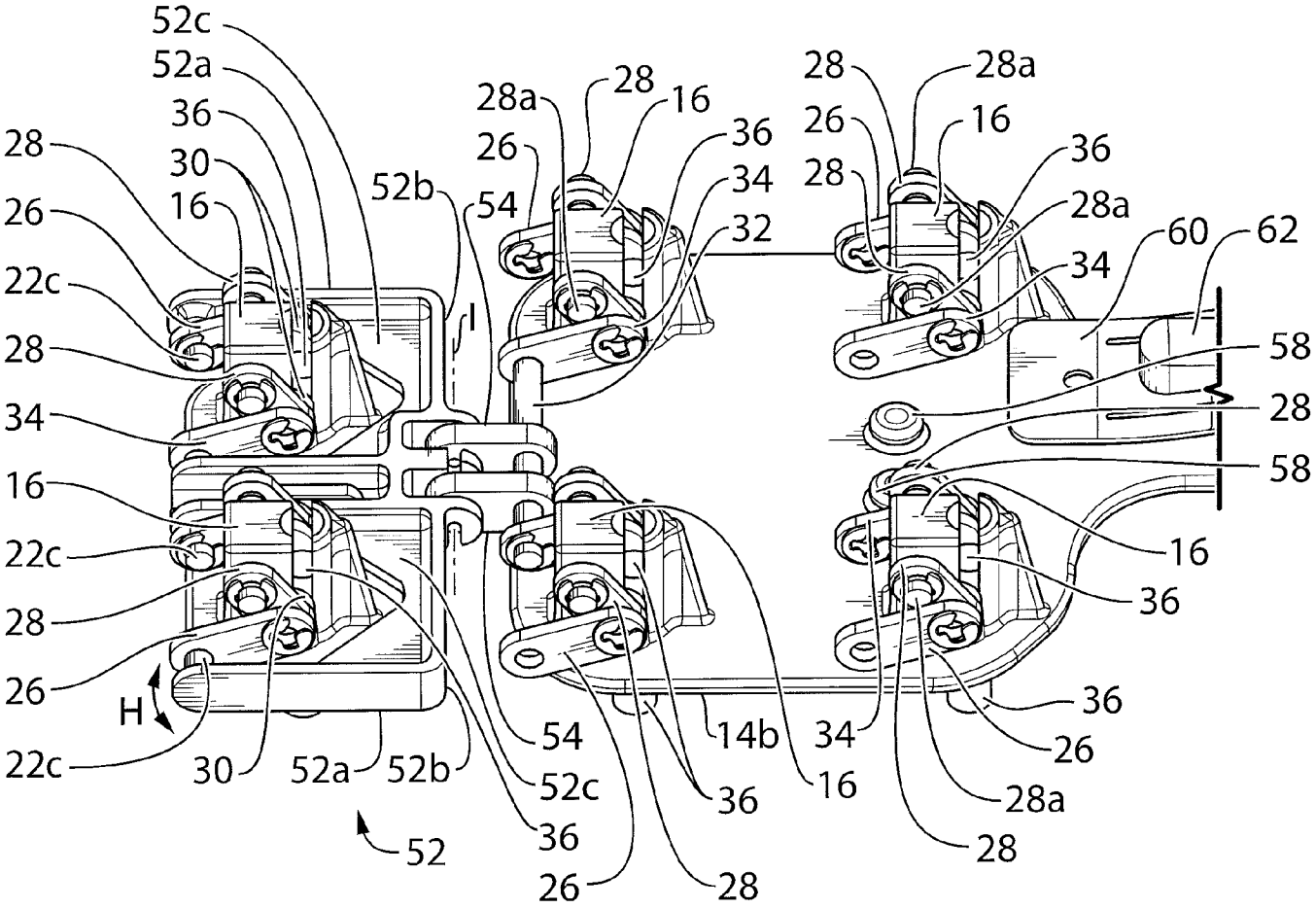
FIG. 15 is, in perspective view, the spike actuating mechanism of FIG. 14 with the shifter frame removed.
Figure 16:
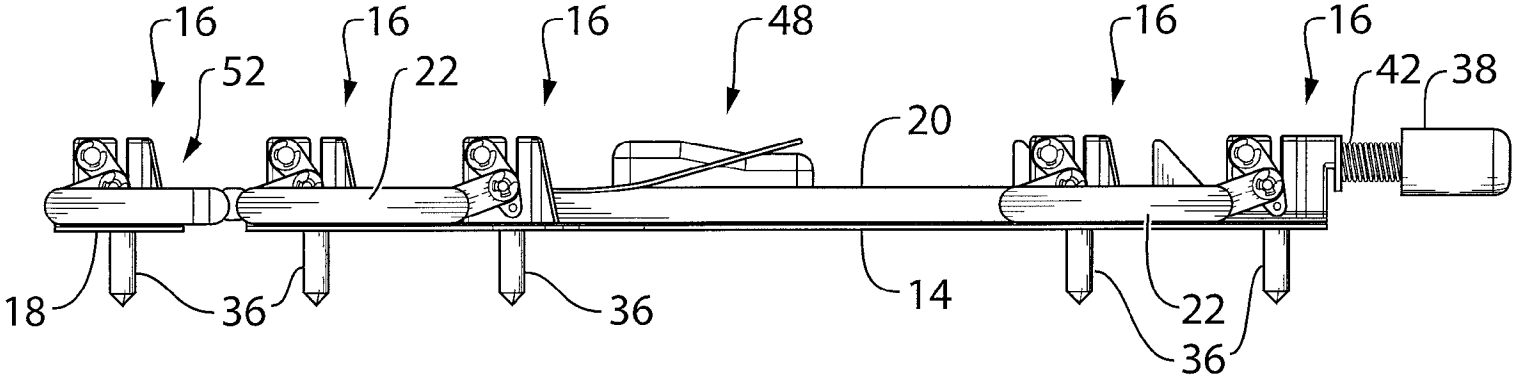
FIG. 16 is, in side elevation view, the spike actuating mechanism of FIG. 8.
Figure 17:
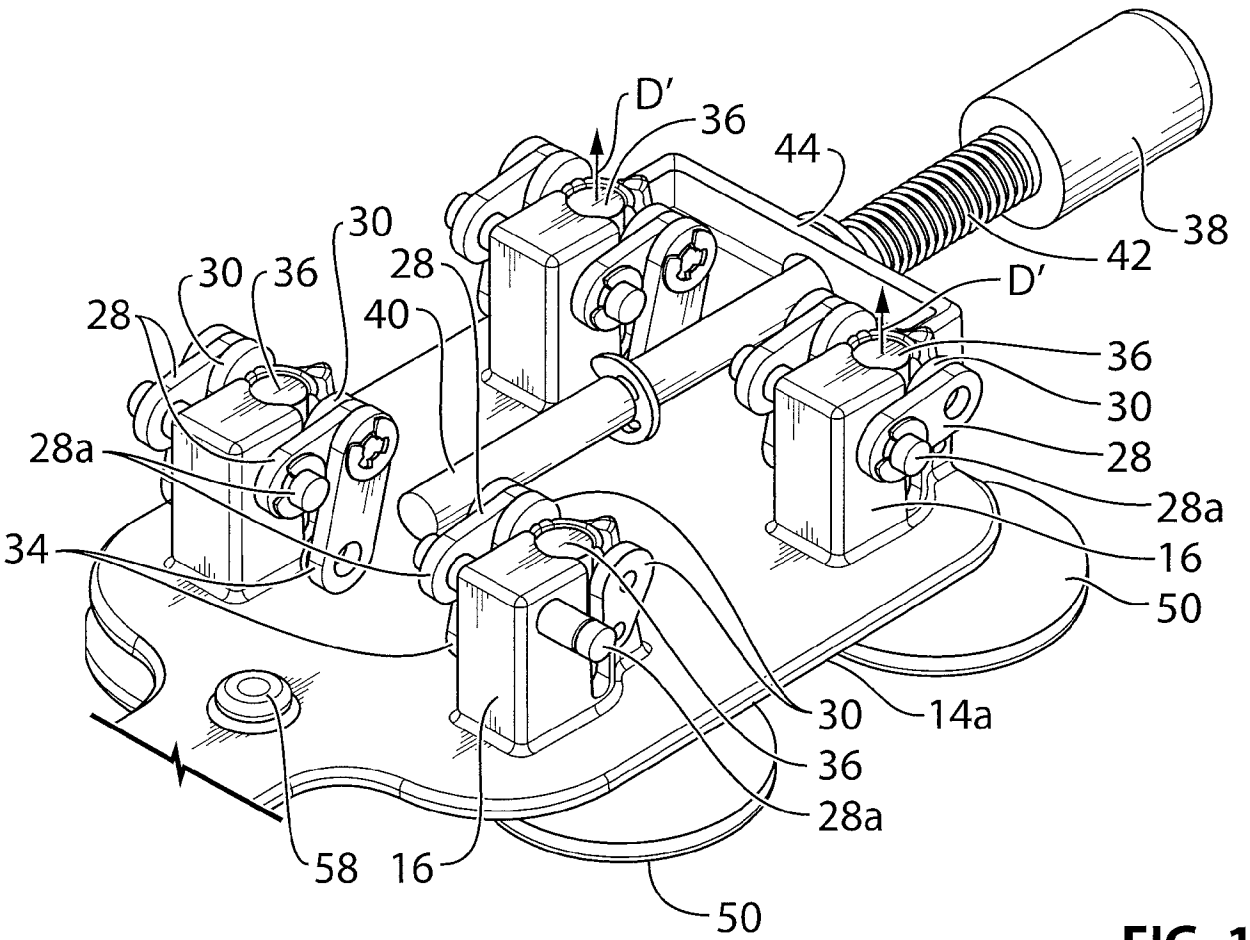
FIG. 17 is, in enlarged perspective view, the heel portion of the spike actuating mechanism of FIG. 6 wherein two outermost knee-links have been removed from one spike guide and wherein the single outermost knee-link has been removed from another of the spike guides to illustrate in more detail the arrangement of the three knee-links on either side of each spike guide in the spike actuating mechanism according to the present invention.
Figure 18:
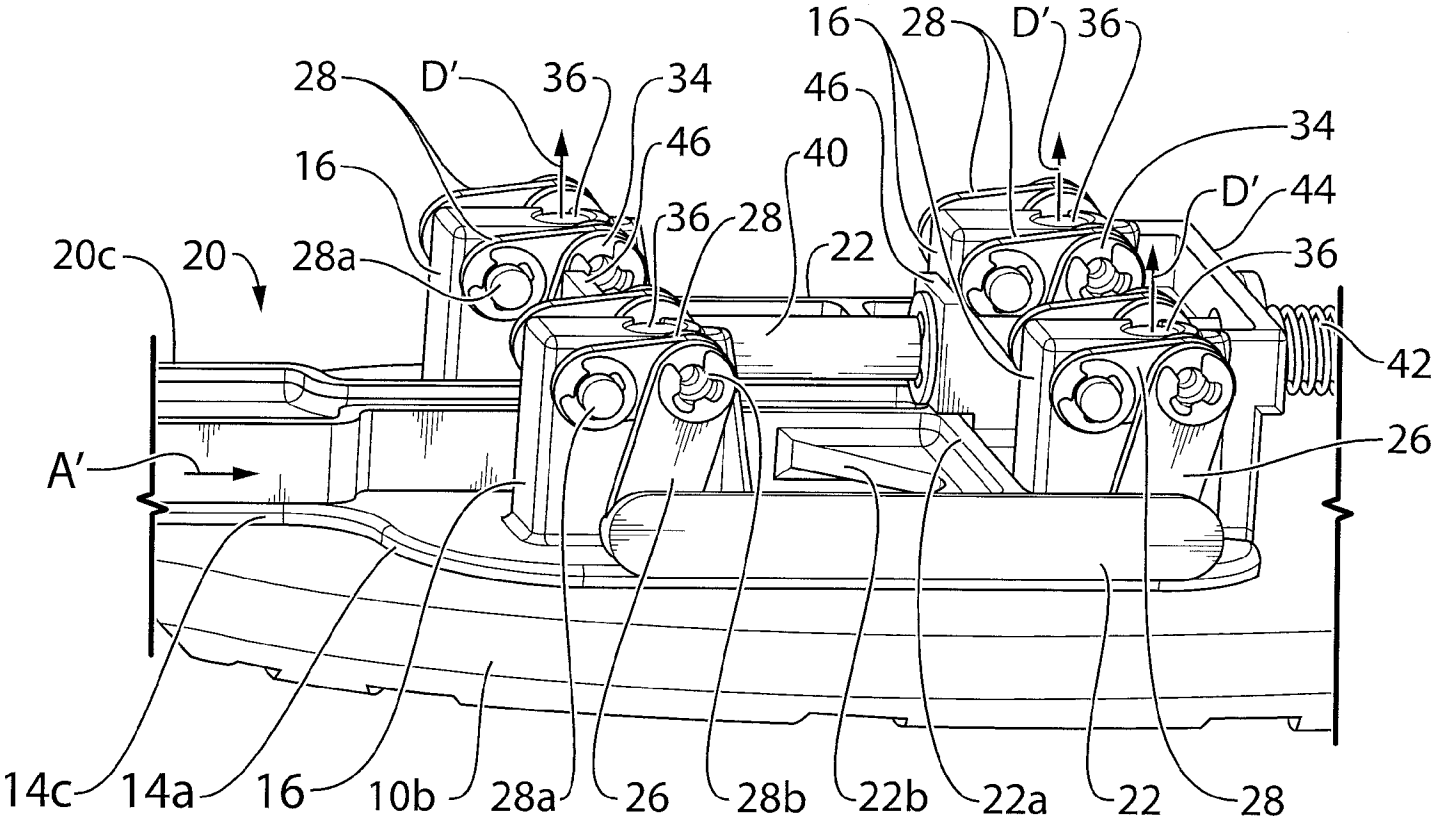
FIG. 18 is in enlarged perspective view the heel portion of the spike actuating mechanism of FIG. 3.
Figure 19:
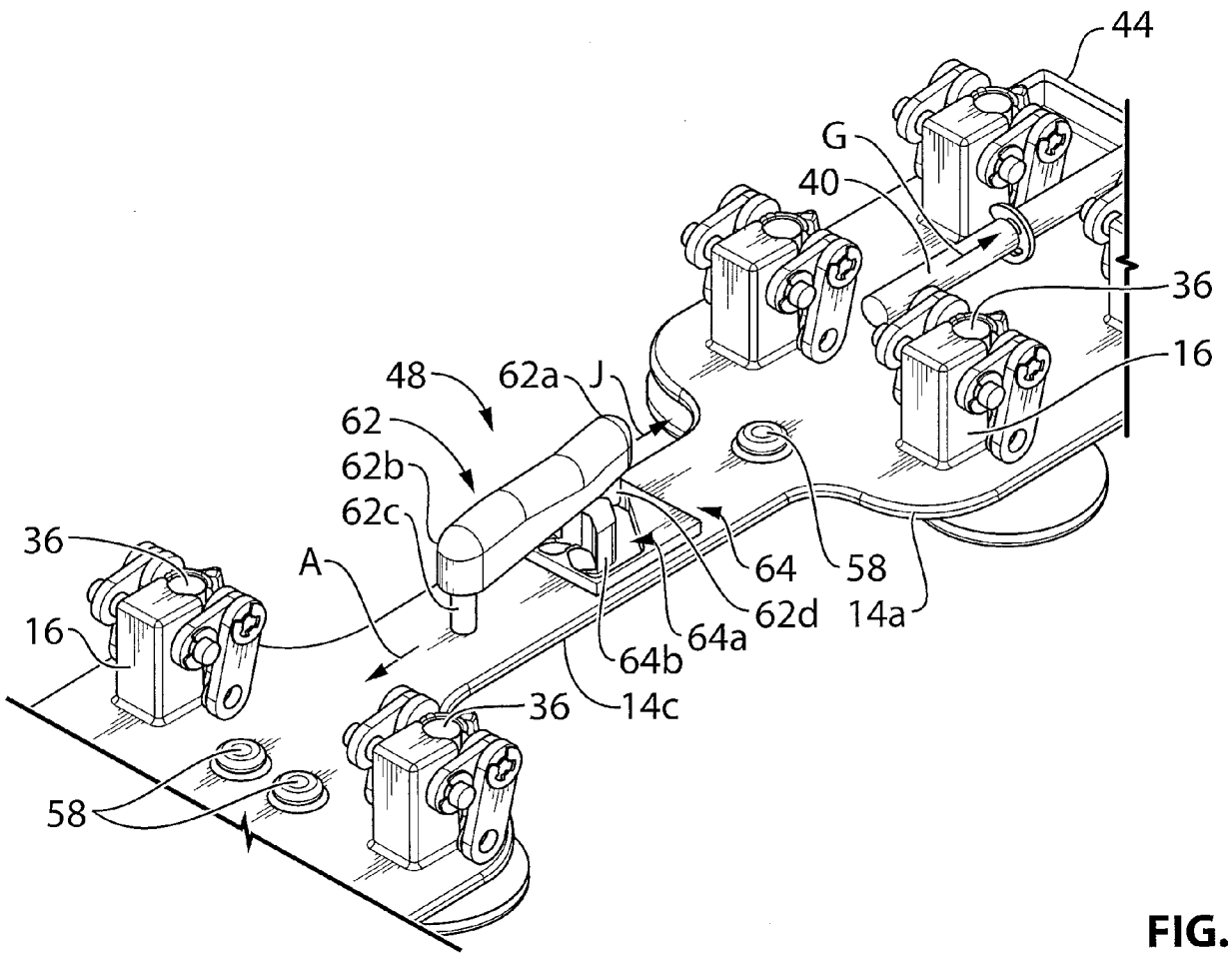
FIG. 19 is, in perspective view, an enlarged center portion of the spike actuating mechanism of FIG. 6.
Figure 20:
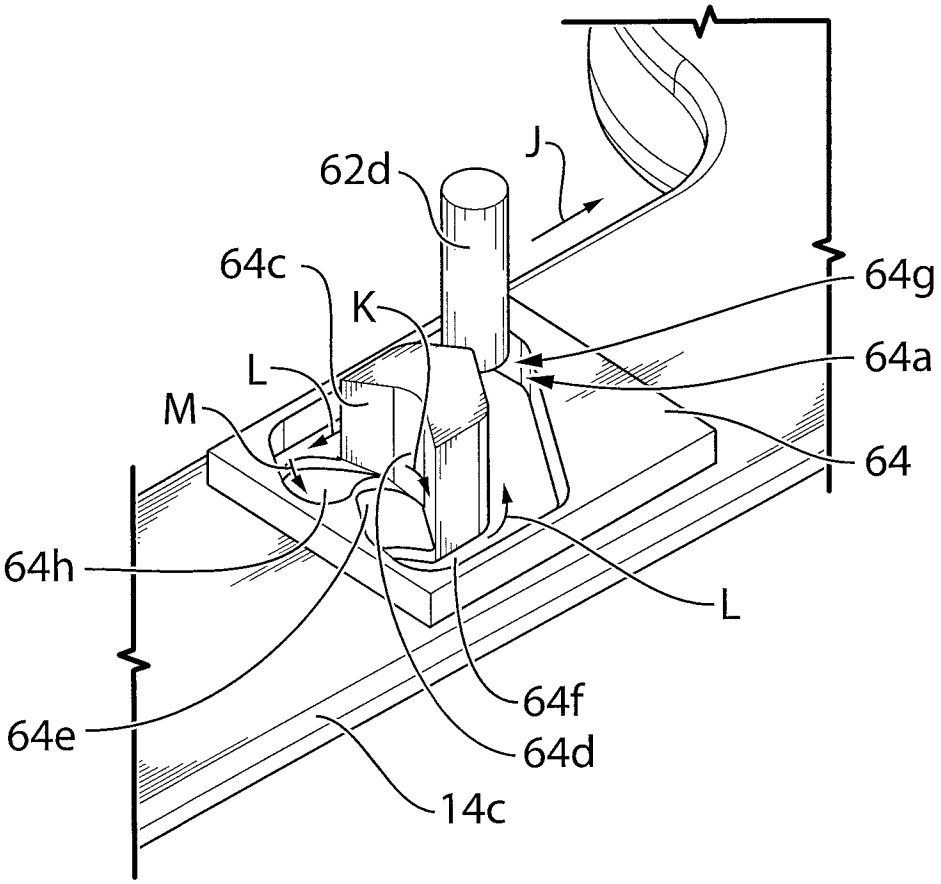
FIG. 20 is a further enlarged view of the push button actuator as illustrated in FIG. 19 with the pin holder removed.
Figure 35A:
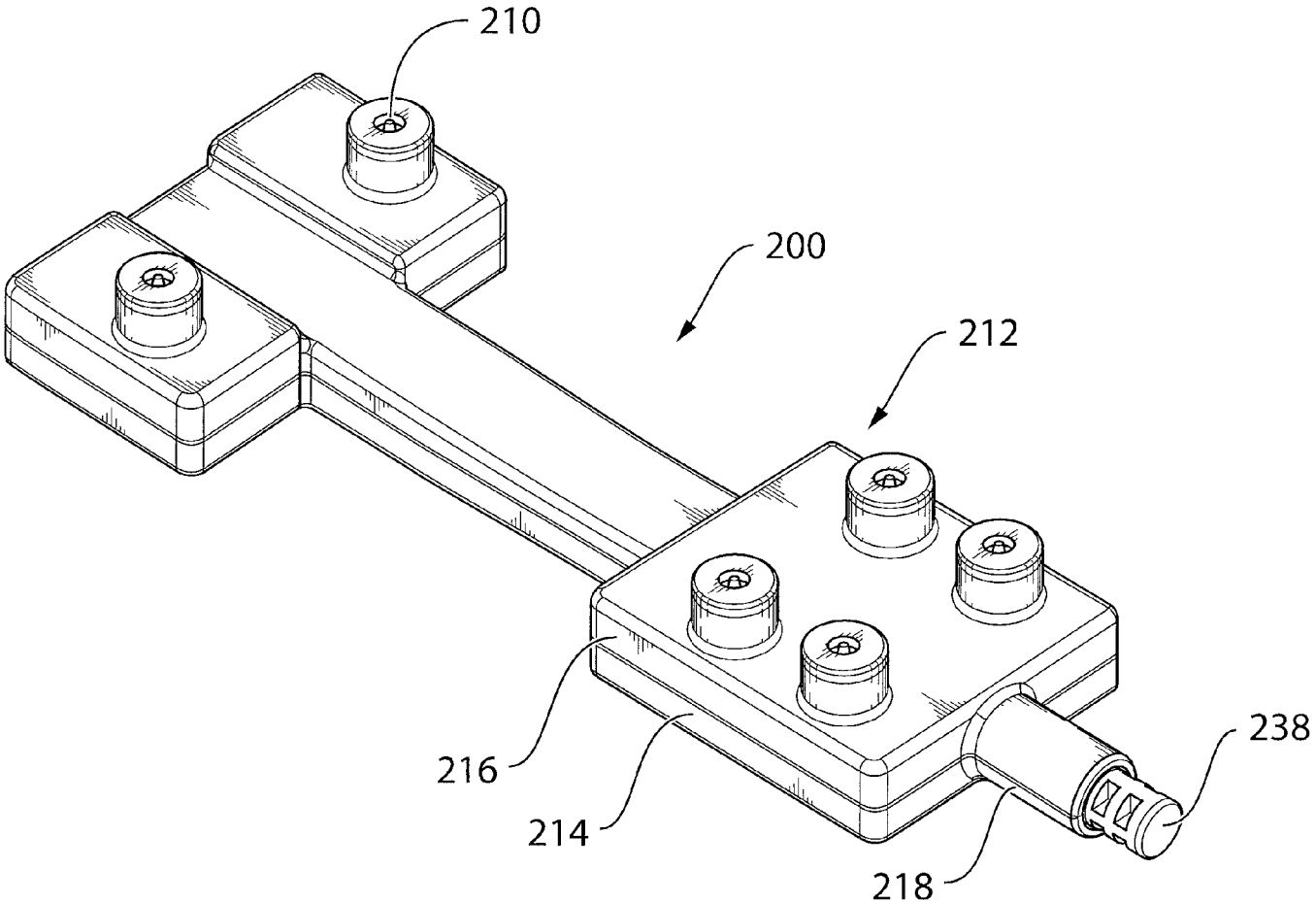
FIG. 35*a* is, in bottom perspective view, an apparatus for selectively extending spikes from the bottom of a footwear article according to a further embodiment, showing the spikes retracted.
Figure 35B:
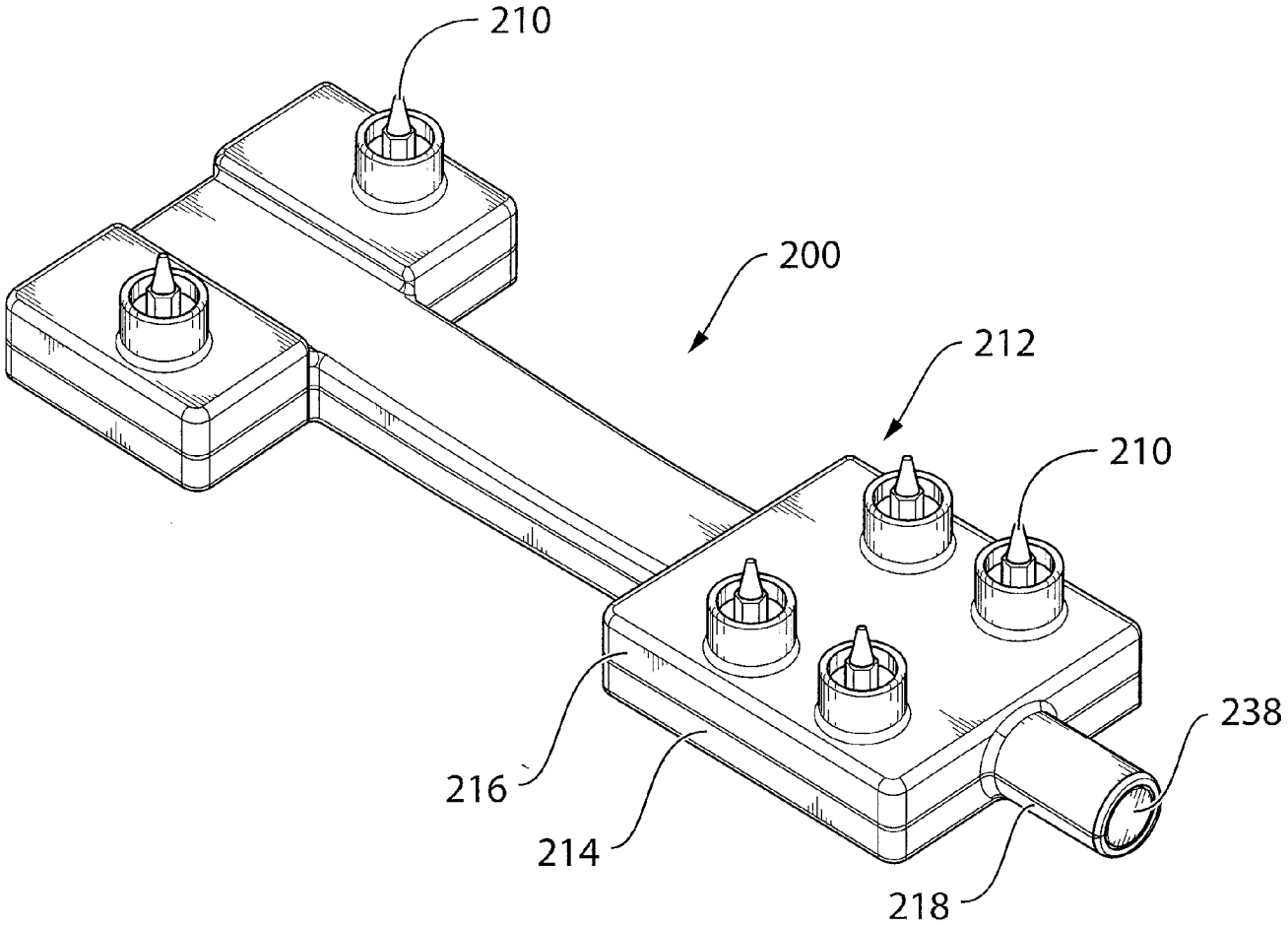
FIG. 35*b* is the view of FIG. 35*a* showing the spikes extended.

In the further embodiment according to one aspect of the present invention as illustrated commencing in FIGS. 35*a* and 35*b*, apparatus 200 is illustrated in a bottom perspective view showing, respectively, spikes 210 in their retracted and extended positions so as to extend from the bottom of the footwear article (not shown). As described above, the footwear article has a sole having a longitudinal direction and containing a plurality of spike apertures from which the spikes 210 extend. For example, as seen in FIG. 2, the spikes extend through apertures in sole portions 50.

Figure 36A:
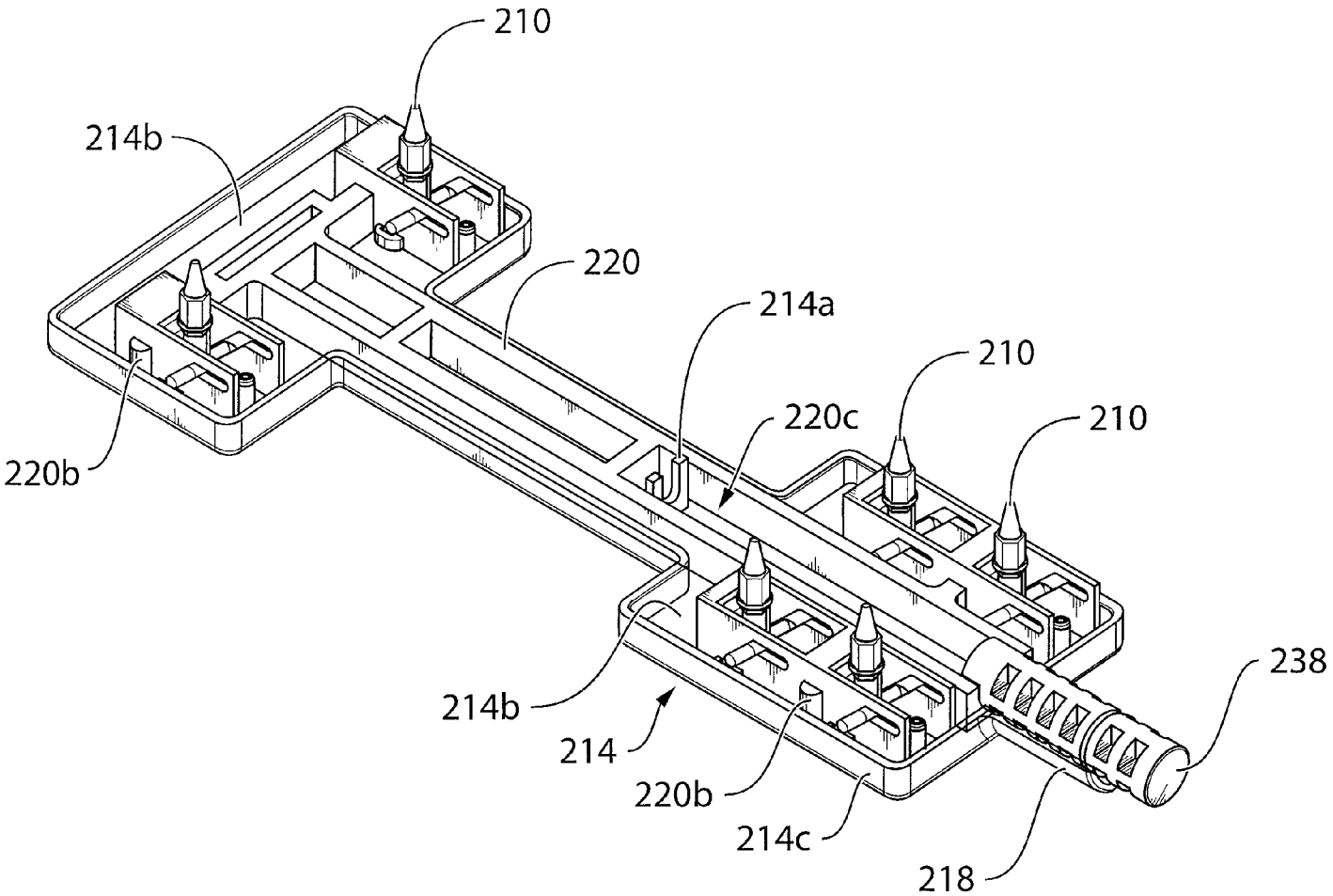
FIG. 36*a* is the view of FIG. 35*a* with the lower half of the housing cover removed.
Figure 36B:
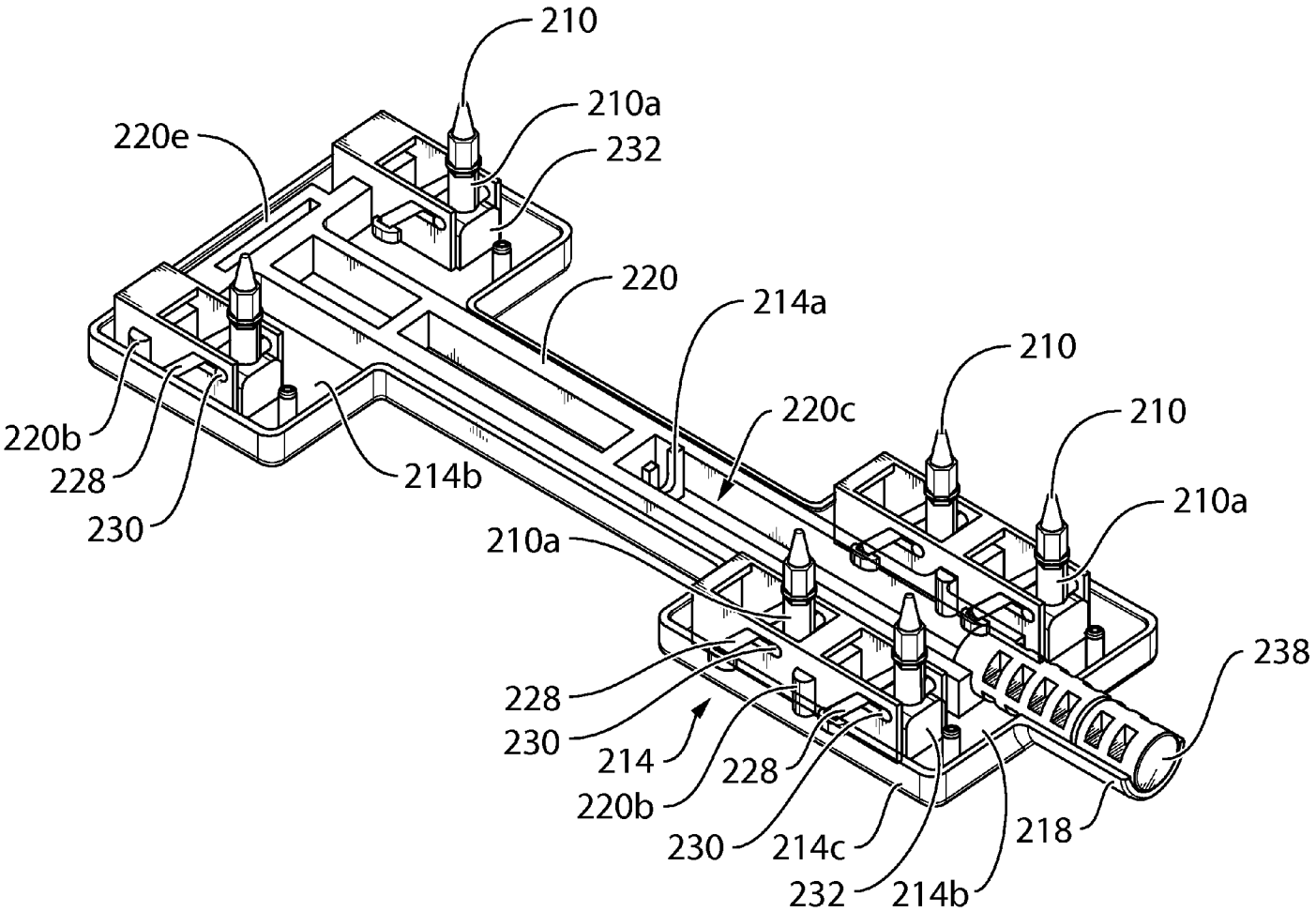
FIG. 36*b* is the view of FIG. 36*a* with the push button and slider translated and the spikes thereby extended.

As seen in FIGS. 35*a* and 35*b*, apparatus 200 is housed within housing 212. Housing 212 is, in the illustrated embodiment, which is not intended to be limiting, made up of upper and lower clam-shell housing 214 and 216 respectively. Upper and lower housing 214 and 216 are mounted together, or for example may be formed as a unitary housing 212, so as to define an interior cavity better seen in FIGS. 36*a* and 36*b*. In FIG. 35*a*, plunger push button 238 is shown in its extended position corresponding to when spikes 210 are refracted within housing 212. In FIG. 35*b*, push button 238 is shown slid into its corresponding collar 218 in housing 212. Push button 238 has thereby actuated the cyclically alternating positioner, indicated in FIG. 1 by reference numeral 48 (not shown in FIGS. 36*a* and 36*b* onwards), so as to extend spikes 210 from housing 212.

Figure 37A:
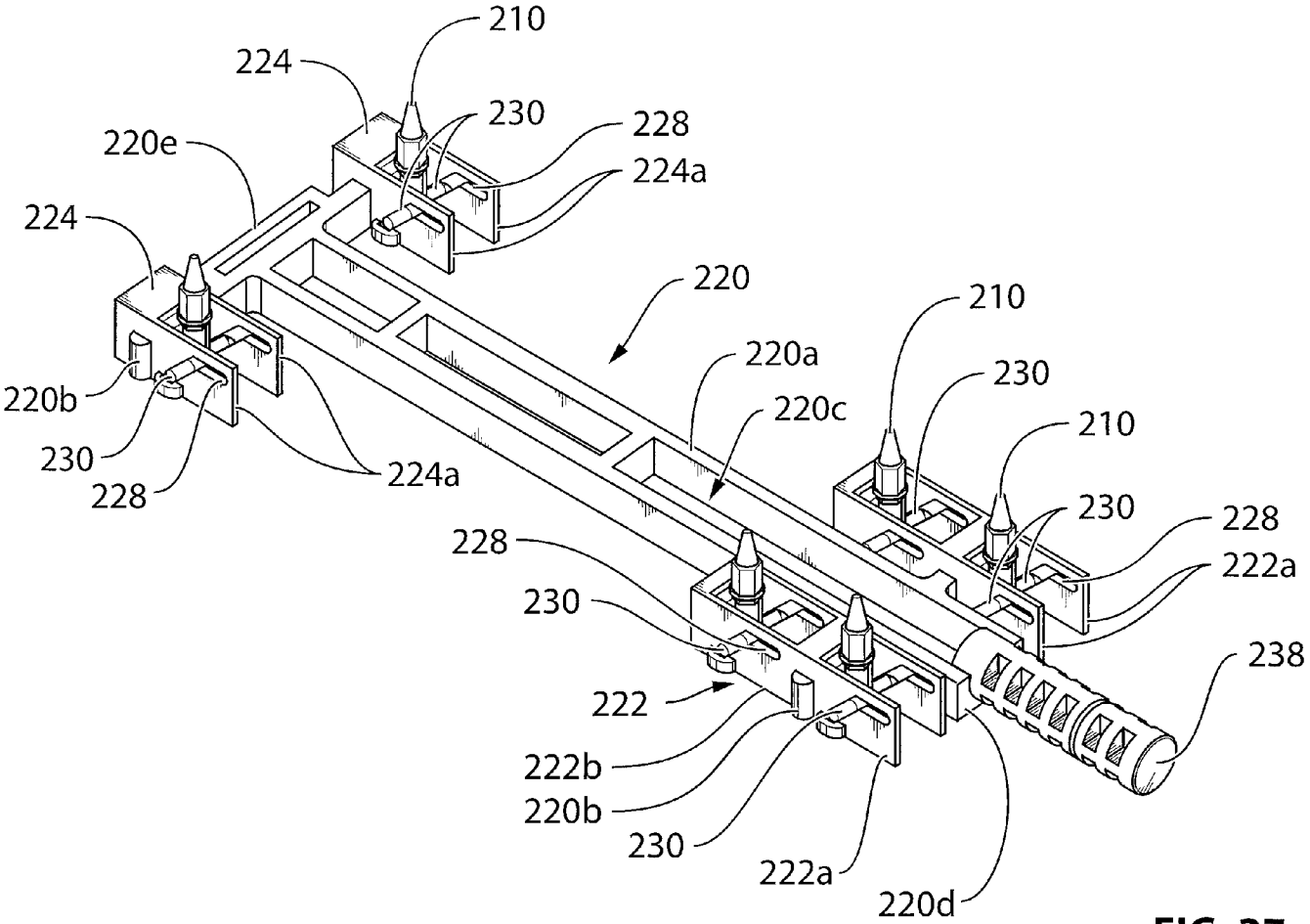
FIG. 37*a* is the view of FIG. 36*a* with the upper half of the housing cover removed.
Figure 37B:
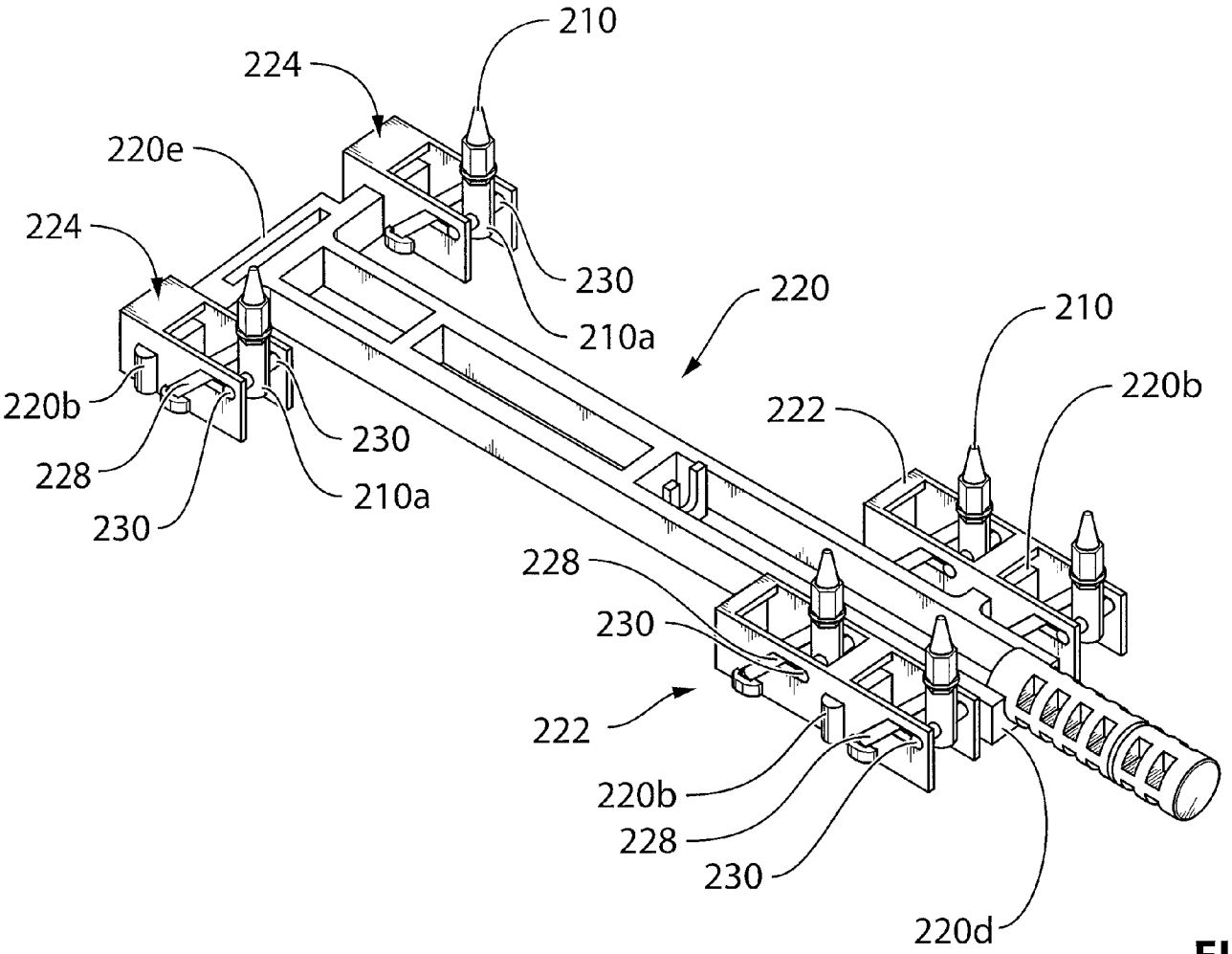
FIG. 37*b* is the view of FIG. 37*a* with the spikes extended.
Figure 38:
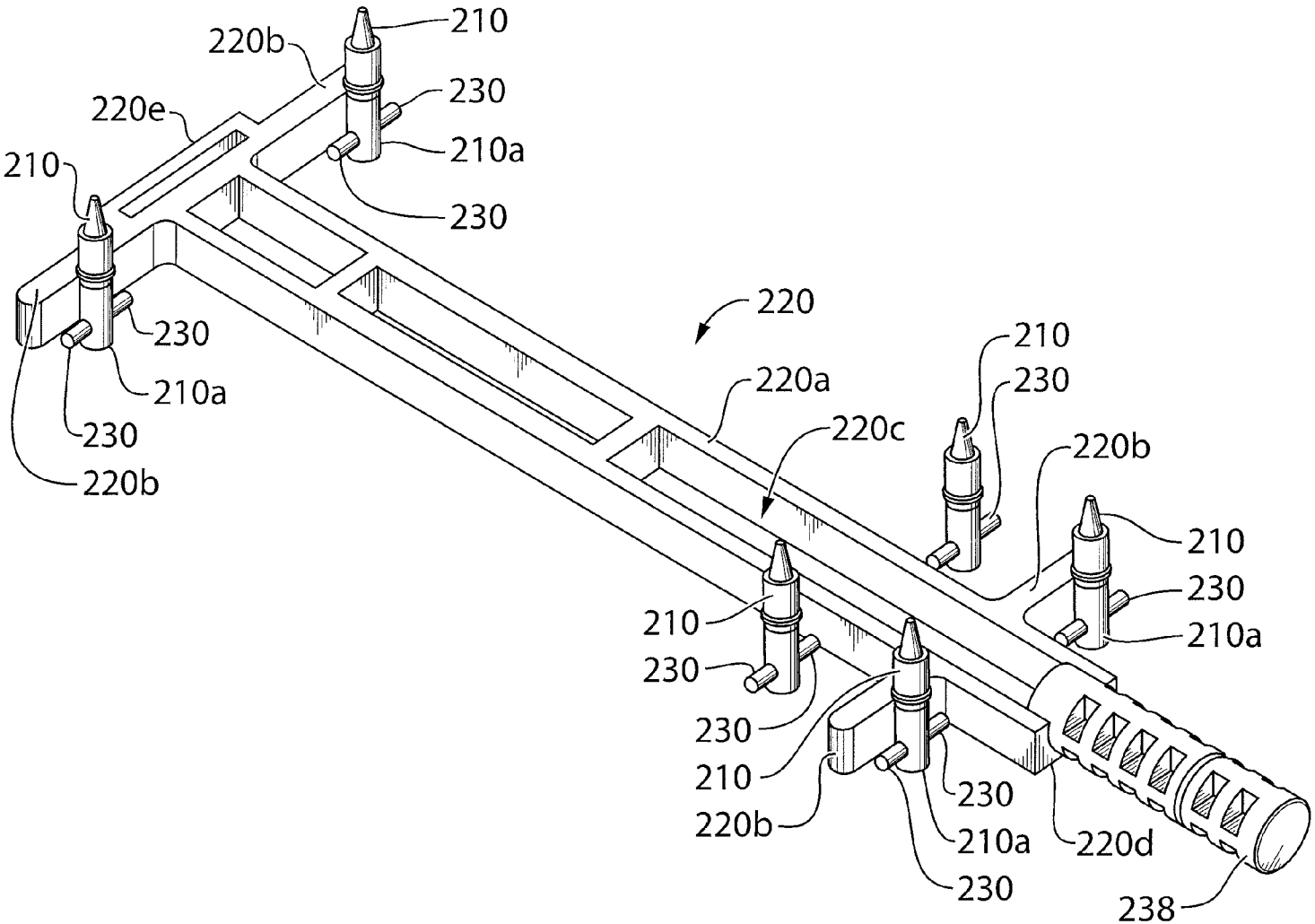
FIG. 38 is the view of FIG. 37*a* with the carriages removed.

As better seen in FIGS. 37*a*, 37*b*, and 38, an elongate slider member 220 (shown in FIG. 38 adjacent six spikes 210 as they would be positioned relatively to slider member 220 in FIG. 36*a*) includes a longitudinal extending backbone or central frame 220*a* supporting at oppositive ends thereof transversely extending lateral arms 220*b*. Central frame 220*a* may be constructed of a pair of parallel rigid members which define a cavity 220*c* therebetween. Cyclically alternating positioner 48 (not shown) is mounted into cavity

220*c*. Actuating push button 238 is mounted to frame 220*a*, within cavity 220*c*, so that, when push button 238 is pushed into its retracted position shown in FIG. 36*b*, push button 238 pushes against, so as to actuate cyclically alternating positioner 48. Alternating positioner 48 may be mounted on mounting bracket 214*a* which itself is mounted to upper half 214. Alternating positioner 48 braces against mounting bracket 214*a* as push button 238 is actuated so as to plunge against alternating positioner 48 in cavity 220*c*. Push button 238 is mounted to central frame 220*a* so that, as push button 238 is actuated, it simultaneously slides slider member 220 longitudinally relative to upper half 214. In particular, slider member 220 slides over, flush against, plate 214*b* of upper half 214. Plate 214*b* extends so as to cover the area defined by the rim 214*c* of upper half 214.

As better seen in FIGS. 39*a* and 39*b*, 40*a* and 40*b*, 41*a* and 41*b*, and 42*a* and 42*b*, rear carriages 222 and forward carriages 224 are mounted, respectively, to the rear end 220*d* and forward end 220*e* of slider member 220 by means of lateral arms 220*b* extending from central frame 220*a* through side wall apertures 226. The side wall apertures are formed in side walls 222*a* and 224*a* in rear carriages 222 and forward carriages 224 respectively. Thus, as slider member 220 is slid longitudinally relative to plate 214*b*, lateral arms 220*b* carry carriages 222 and 224 simultaneously in sliding translation also over plate 214*b*.

Figure 39A:
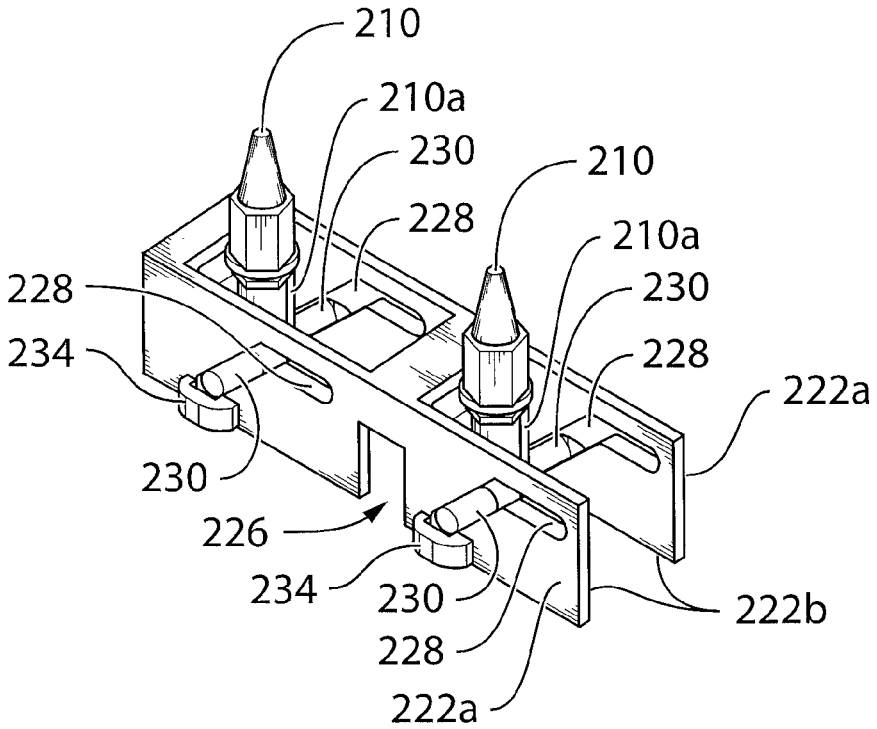
FIG. 39*a* is an enlarged view of a portion of FIG. 37*a*.
Figure 39B:
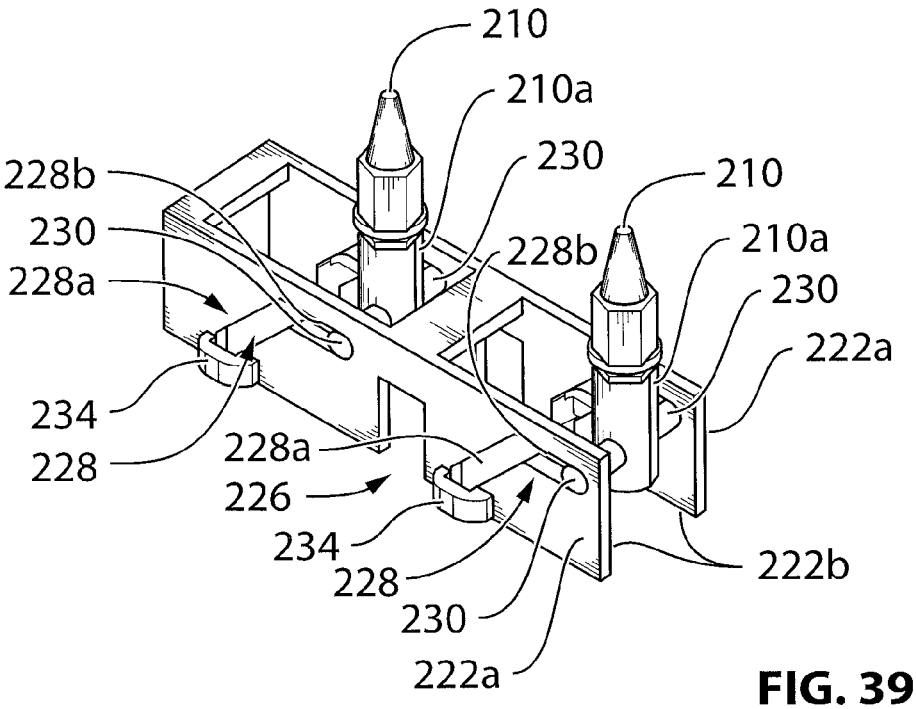
FIG. 39*b* is an enlarged view of a portion of FIG. 37*b*.
Figure 40A:
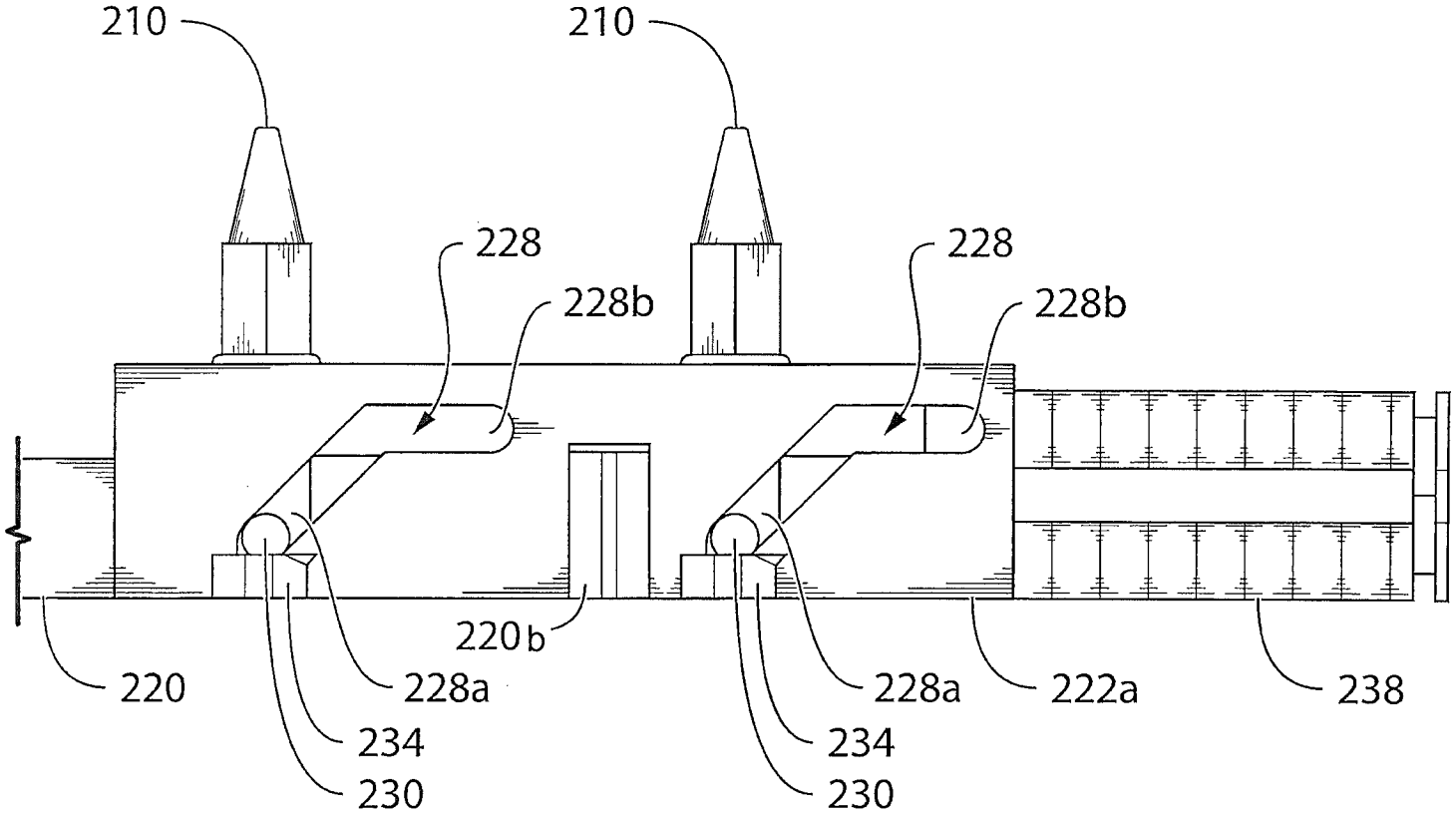
FIG. 40*a* is, in side elevation view, an enlarged portion of FIG. 37*a*.
Figure 40B:
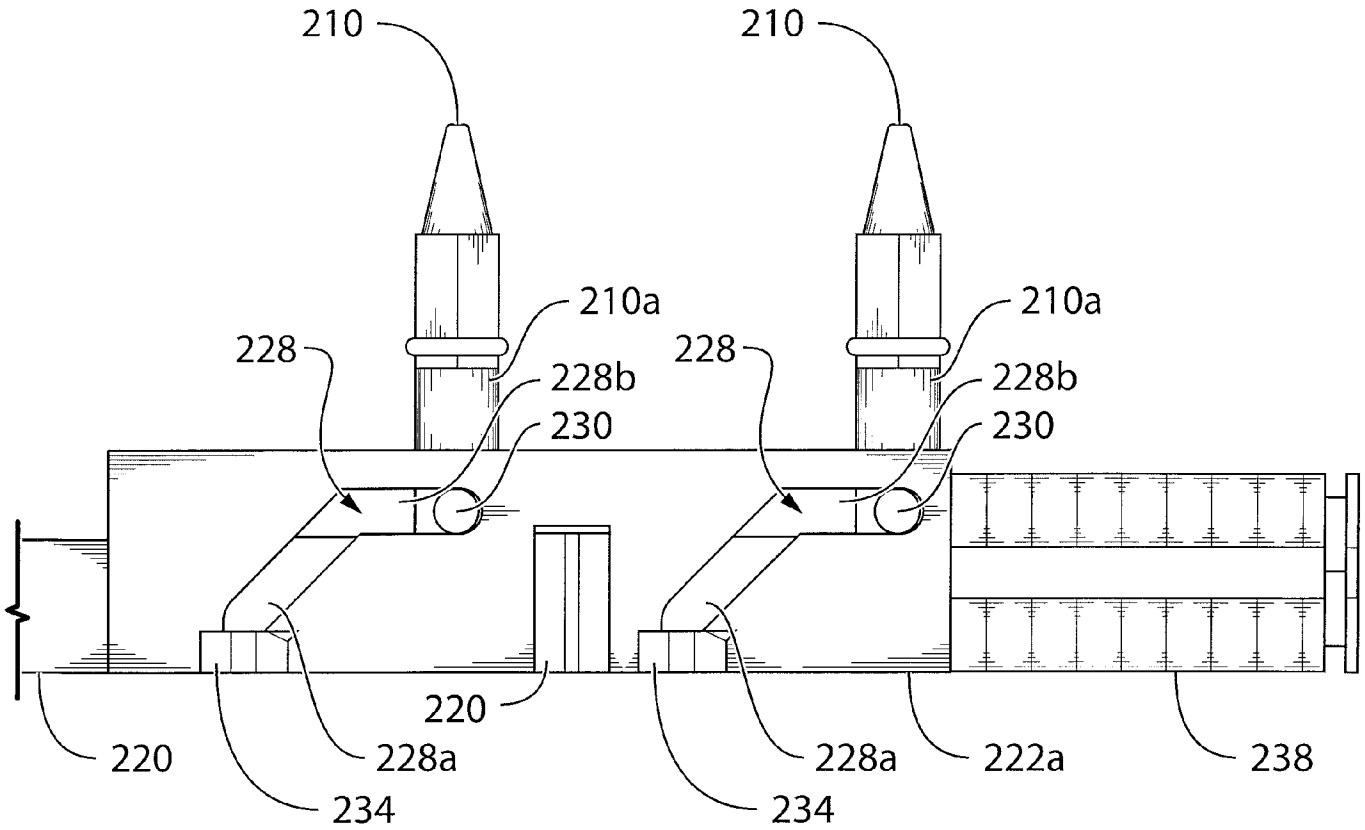
FIG. 40*b* is, in side elevation view, an enlarged portion of FIG. 37*b*.
Figure 41A:
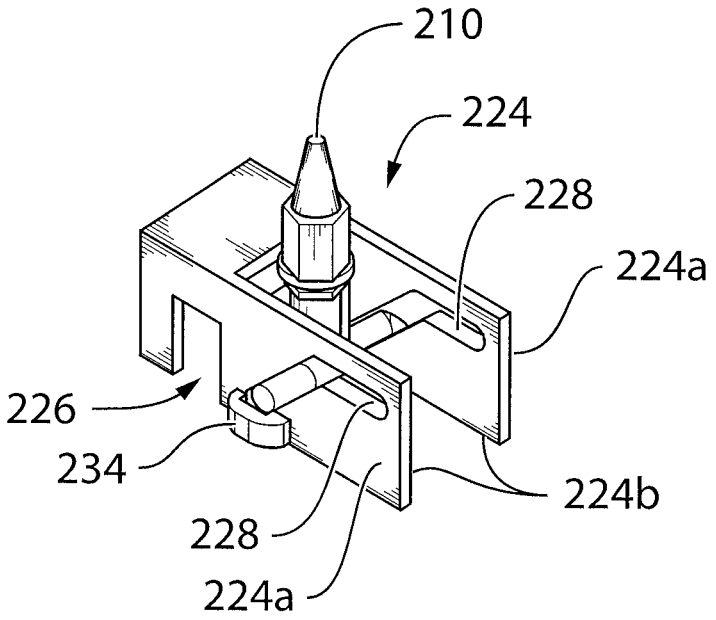
FIG. 41*a* is an enlarged view of a further portion of FIG. 37*a*.
Figure 41B:
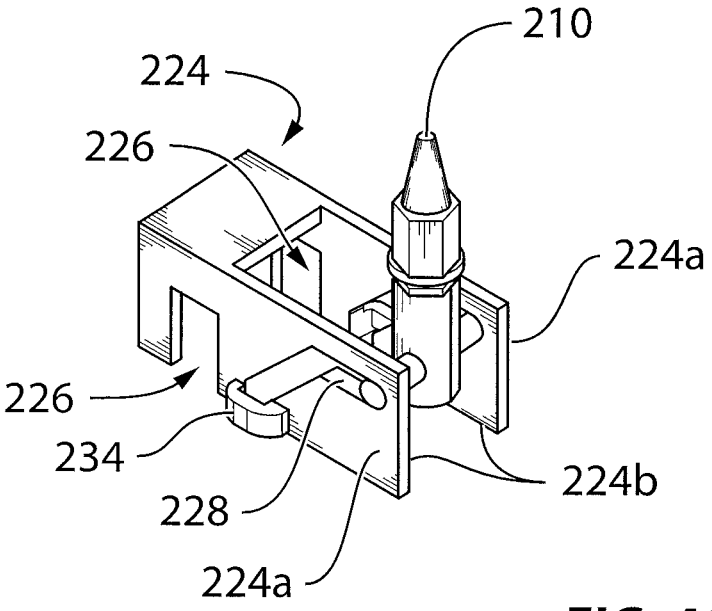
FIG. 41*b* is an enlarged view of a further portion of FIG. 37*b*.
Figure 42A:
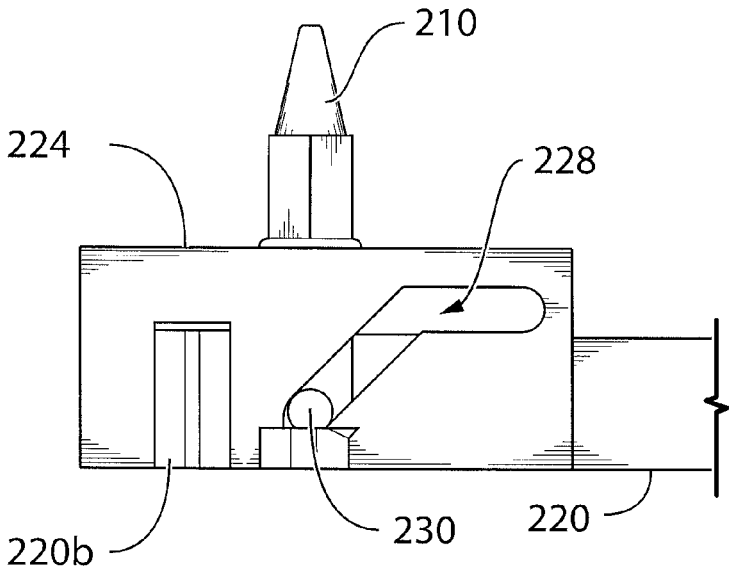
FIG. 42*a* is, in side elevation, the enlarged portion of FIG. 41*a*.
Figure 42B:
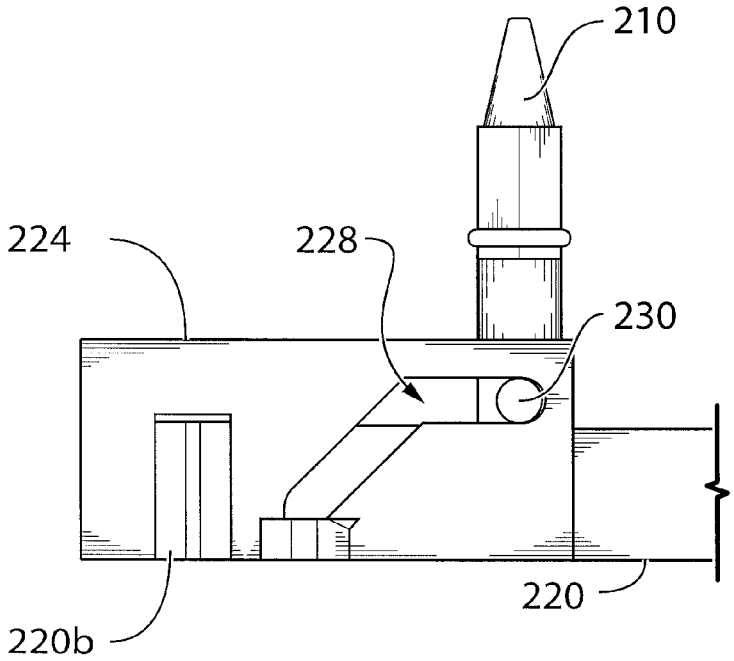
FIG. 42*b* is, in side elevation, the enlarged portion of FIG. 41*b*.

Cam slots 228 are formed, respectively, in side walls 222*a* and 224*a* of carriages 222 and 224. In the illustrated embodiment, which is not intended to be limiting, side walls 222*a* and 224*a* are substantially vertical, that is, substantially perpendicular to plate 214*b*, so that cam slots 228 lie substantially in corresponding vertical planes. Cam slots 228 provide an elongate continuous path in the carriage side walls for cam followers 230 to slide along. Again without intending to be limiting, as illustrated, cam followers may be laterally extending pins or shafts mounted to or formed as part of the vertically oriented base members 210*a* of spikes 210. Cam followers 230 are sized so as to slide snugly in and along cam slots 228 from the elevated position within the upper end of cam slots 228 as shown in FIG. 39*a* (keeping in mind that the illustrated views are looking at the bottom of the apparatus), and the lower most position of cam followers 230 at the lower ends of cam slots 228 as seen in FIG. 39*b*. Thus in FIG. 39*a*, with the cam followers 230, and thus correspondingly spikes 210, fully elevated relative to carriages 222, spikes 210 are fully retracted. In FIG. 39*b*, with the cam followers 230 in their fully lower position relative to carriage 222, spikes 210 are fully extended.

In a preferred embodiment such as that illustrated, which is not intended to be limiting, the upper portion 228*a* of cam slots 228 are inclined, for example, at approximately 45 degrees relative to plate 214*b* (otherwise referred to as being relative to the horizontal) and a contiguous lower portion 228*b* of cam slots 228 are substantially horizontal. Thus when cam followers 230 are in their elevated position, the cam followers reside in the upper end of upper portions 228*a*, and when the cam followers 230 are in their lowered position, they are resting along the horizontal lower portion 228*b* of the corresponding cam slots. In this fashion, when spikes 210 are extended, and when a user is walking on the footwear with spikes 210 extended, the load transferred to spikes 210 due to the weight of the user bearing down against the ground, is transferred upwardly through spikes 210 and base members 210*a*, and, via cam followers 230, to side walls 222*a* and 224*a* of carriages 222 and 224 respectively by cam followers 230 bearing against the horizontal surfaces of the lower portion 228*b* of cam slots 228.

The side walls 222*a* and 224*a* of carriages 222 and 224 have elongate upper edges 222*b* and 224*b* respectively which lie flush against plate 214*b* so as to evenly distribute the load from spikes 210 to plate 214*b*. Distributing the load evenly to plate 214*b* from carriages 222 and 224 reduces the relative friction between the carriages and plate 214*b* and reduces the risk of mis-alignment or jamming of the carriages against the plate when it is desired to retract the spikes. Spikes 210 are refracted by the operation of push button 238 causing slider member 220 to slide rearwardly relative to plate 214*b*. Thus as slider 220 slides rearwardly, that is, to the right in FIGS. 36*a* and 36*b*, carriages 222 and 224 are also carried rearwardly. The base members 210*a* of spike 210 are siloed, that is, held for substantially vertical sliding translation, within spike guides 232 mounted to plate 214*b*. Although, spike guides 232 may be hollow sleeves or hollow blocks as illustrated, this is not intended to be limiting, so long as spikes 210 and their corresponding base members 210*a* are supported substantially vertically within spike guides 232 to thereby allow sliding translation of base members 210*a* vertically into and out of their snug fit within the spike guides. Because cam followers 230 extend laterally from bases 210*a* so as to slide in and along cam slots 228, it will be understood that the side walls of spike guides 232 have vertical slots (not shown) therein to allow the vertical translation therethrough of cam followers 230. Thus as cam followers 230 are raised and lowered by sliding along cam slots 228, spikes 210 and base members 210*a* slide vertically relative to spike guides 232.

In one embodiment not intended to be limiting, lateral stabilizers 234 extend from the side walls of carriages 222 and 224 so as to assist stabilizing the sliding translation of the carriages over plate 214*b*. The lateral stabilizers 234 engage in sliding translation against rim 214*c*.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An apparatus for selectively extending spikes from the bottom of a footwear article, the footwear article having a sole having a longitudinal direction and a plurality of spike apertures, the apparatus comprising:

a plurality of spike assemblies, each of said plurality of spike assemblies having a spike guide and a selectively translatable spike slidably supported in said guide, wherein each said spike has a cam follower coupled thereto and extending from said spike for translation with said spike, said spike being locatable within one of the spike apertures in the footwear article, an elongate member mountable into the footwear article so as to be translatable substantially parallel to the longitudinal direction of the footwear article, said elongate member cooperating with said plurality of spike assemblies and moveable between first and second positions relative thereto so as to extend said spikes from said plurality of spike assemblies when in said first position and to retract said spikes within said plurality of spike assemblies when in said second position, a cyclically alternating positioner for moving said elongate member between said first and second positions, said positioner having an actuating button, wherein said actuating button is cantilevered in a substantially horizontal plane and depressing said actuating button a first time causes said positioner to longitudinally move said elongate member in said substantially horizontal plane to said first position and wherein depressing said actuating button a second time causes said positioner to longitudinally move said elongate member in said substantially horizontal plane to said second position, further comprising, for each spike assembly of said plurality of spike assemblies, a carriage coupled to said elongate member and said each spike assembly for transmitting said longitudinal translation of said elongate member to said spike assemblies and wherein said longitudinal translation of said elongate member between said first and second positions causes longitudinal translation of said carriage between said first and second positions, wherein each said carriage has an inclined cam slot in said carriage, said cam slot having opposite upper and lower ends, and wherein each said cam follower is mounted in sliding registry within a corresponding said inclined cam slot in a corresponding said carriage, and wherein said cam follower is in said lower end of said cam slot when said elongate member is in said first position and said cam follower is in said upper end of said cam slot when said elongate member is in said second position.

2. The apparatus of claim 1 wherein said actuating button is a single button.

3. The apparatus of claim 1 wherein said actuating button comprises a plunger button acting against a return biasing spring.

4. The apparatus of claim 3 wherein said plunger button is cantilevered in a substantially horizontal plane.

5. The apparatus of claim 1 wherein each said cam slot lies in a vertical plane.

6. The apparatus of claim 5 wherein in said carriage includes at least one wall, and wherein said cam slot is formed in said at least one wall.

7. The apparatus of claim 1 wherein each said carriage is coupled to said elongate member by a corresponding arm extending between said carriage and said elongate member.

8. The apparatus of claim 7 wherein each said carriage extends on opposite sides of each said spike assembly and wherein said at least one wall is two walls, one on each side of each said spike assembly, and wherein one said cam slot is formed in each wall of said two walls, and wherein said cam follower is a pair of cam followers extending from opposite sides of each said spike into corresponding said cam slots so as to support each said spike from both sides thereof.

9. The apparatus of claim 8 wherein said at least one arm extends from said elongate member to both of said two walls of said carriage.

10. The apparatus of claim 9 wherein said guide is a sleeve.

11. The apparatus of claim 10 wherein said elongate member is sandwiched between a pair of plates for sliding translation between said pair of plates, and wherein each said sleeve is mounted so as to extend from at least one plate of said pair of plates.

12. The apparatus of claim 11 wherein each said carriage is shaped as an inverted channel and wherein each said channel has a floor and said two walls extend from said floor, wherein said pair of sidewalls are said two walls and wherein said floor has a cut-out for movement of a corresponding said spike therethrough.

13. The apparatus of claim 1 wherein said cam slot has an inclined portion and a horizontal portion, wherein said horizontal portion is at said lower end of said cam slot, and wherein a corresponding said cam follower is positioned in said horizontal portion of said cam slot when said elongate member is said first position with said spikes extended, whereby vertical loading on said spike is transmitted directly to said carriage.

14. The apparatus of claim 13 further comprising a plate, and wherein said carriage slides along said plate.

15. The apparatus of claim 14 wherein said carriage bears against said plate so as to distribute said vertical loading to said plate, whereby sliding friction between said carriage and said plate is reduced and pressure due to said loading from said carriage against said plate is distributed to said plate to minimize interference with said sliding of said carriage on said plate.

16. The apparatus of claim 15 wherein said plate is an upper plate and wherein said carriage and said elongate member are slidably mounted underneath said upper plate.

17. The apparatus of claim 16 further comprising a lower plate, and wherein said elongate member is sandwiched, for sliding translation, between said upper and lower plates.

* * * * *